US007824005B2

(12) United States Patent
Yakura et al.

(10) Patent No.: US 7,824,005 B2
(45) Date of Patent: Nov. 2, 2010

(54) LIQUID EJECTION DEVICE

(75) Inventors: Yuji Yakura, Kanagawa (JP); Masahiro Koike, Kanagawa (JP); Shota Nishi, Kanagawa (JP); Yasuhiro Tanaka, Kanagawa (JP)

(73) Assignee: Sony Corporation, Tokyo (JP)

( * ) Notice: Subject to any disclaimer, the term of this patent is extended or adjusted under 35 U.S.C. 154(b) by 874 days.

(21) Appl. No.: 11/511,801

(22) Filed: Aug. 29, 2006

(65) Prior Publication Data

US 2007/0057990 A1 Mar. 15, 2007

(30) Foreign Application Priority Data

Sep. 2, 2005 (JP) ..... 2005-255690
Jun. 16, 2006 (JP) ..... 2006-167884

(51) Int. Cl.
*B41J 2/165* (2006.01)

(52) U.S. Cl. ..... 347/31

(58) Field of Classification Search ..... 347/31–33
See application file for complete search history.

(56) References Cited

U.S. PATENT DOCUMENTS

2002/0140762 A1* 10/2002 Sharma et al. ..... 347/28
2005/0012777 A1* 1/2005 Ishihara ..... 347/29
2005/0134629 A1* 6/2005 Martin et al. ..... 347/22

FOREIGN PATENT DOCUMENTS

| | | |
|---|---|---|
| JP | SHO 57-34969 | 3/1982 |
| JP | 57-34969 | 9/1983 |
| JP | 02-198859 | 8/1990 |
| JP | 04-185450 | 7/1992 |
| JP | HEI 4-185450 | 7/1992 |
| JP | 2738855 | 1/1998 |

* cited by examiner

*Primary Examiner*—Julian D Huffman
*Assistant Examiner*—Jason S Uhlenhake
(74) *Attorney, Agent, or Firm*—Robert J. Depke; Rockey, Depke & Lyons, LLC

(57) ABSTRACT

A liquid ejection device includes: a liquid ejection head which includes an ejection surface and an ejection port formed at the ejection surface, ejects a droplet of liquid from the ejection port, and allows the liquid to land on an object; an elastic absorbing member which comes into contact with the ejection surface of the liquid ejection head, and absorbs the liquid adhering to the ejection surface; and moving means for moving the absorbing member with respect to the ejection surface while the absorbing member is in contact with the ejection surface, in which the absorbing member has a surface layer which is impregnated with a solution containing a surfactant.

2 Claims, 13 Drawing Sheets

LIQUID EJECTION DEVICE

CROSS REFERENCES TO RELATED APPLICATIONS

The present invention contains subject matter related to Japanese Patent Applications JP 2005-255690 and JP 2006-167884 filed in the Japanese Patent Office on Sep. 2, 2005 and on Jun. 16, 2006, respectively, the entire contents of which are incorporated herein by reference.

BACKGROUND OF THE INVENTION

1. Field of the Invention

The present invention relates to a liquid ejection device provided with an absorbing member for cleaning an ejection surface having an ejection port that ejects liquid by absorbing the liquid adhering to the ejection surface.

2. Description of the Related Art

A printer employing ink-jet system (hereinafter, referred to as an ink-jet printer) ejects ink from an ink ejection head onto a recording sheet to print images and characters. The ink-jet printer has advantages of low running cost, reduction in size of the printer, and ease of printing color images.

The ink-jet printer supplies ink from an ink tank to an ink liquid chamber of an ink ejection head. The ink liquid chamber is provided with a pressure-generating element, such as a heating resistor or a piezoelectric element. Then, pressure is applied to the ink in the ink liquid chamber by the pressure-generating element, and a droplet of ink is ejected from microscopic ejection ports, i.e., nozzles. In the ink-jet printer, the ejected droplet of ink is allowed to land on a recording sheet or the like, to print images and characters.

In the ink-jet printer, ink other than the droplet of ink ejected from the nozzles, namely, a so-called satellite ink and the like may adhere to the ejection surface provided with the nozzles of the ink ejection head facing the recording sheet. In the ink-jet printer, for instance, when printing has not been performed for a long time, the ink adhering near the nozzles because of the previous printing operation may be evaporated and dried to be thickened and solidified, or the ink at tip ends of the nozzles may be evaporated and dried through opening ends of the nozzles on the ejection surface. In the ink-jet printer, if the thickened and solidified ink is adhering near the nozzles, the thickened and solidified ink may block ejection of the droplet of ink. Therefore, the droplet of ink may not be ejected, or an ejection direction of the droplet of ink may be disordered.

To avoid this, for instance, there is a method of removing the thickened and solidified ink adhering to the ejection surface by pressing a hardish, rubber cleaning blade onto the ejection surface of the ink ejection head and making the cleaning blade slide on the ejection surface. For example, Japanese Unexamined Patent Application Publication No. 57-34969 discloses a method of increasing wiping effect by attaching a plurality of cleaning blades to a rotation shaft, rotating the rotation shaft, and wiping an ejection surface with the cleaning blades.

However, according to the method using the cleaning blades, since the thickened and solidified ink and dusts adhering to the ejection surface are removed by pressing the hardish cleaning blades onto the ejection surface and making the ejection surface slide on the ejection surface, the cleaning blades apply large force to the ejection surface; possibly damaging the ejection surface. In addition, this method provides only the effect of wiping the ejection surface. Therefore, it may be difficult to remove the ink thickened and solidified at the tip ends of the nozzles. Further, with this method of wiping the ejection surface with the use of the cleaning blade, even if the plurality of cleaning blades are used, the cleaning blade may damage the ejection surface, and it may be difficult to remove the thickened and solidified ink near the nozzles, and that at the tip ends of the nozzles. Therefore, according to the method using the cleaning blade, it is difficult to remove the thickened and solidified ink completely, and unprinted spots or lines may appear because the ink is not ejected or the ejection direction of the ink is deviated in printing. This may deteriorate image quality.

As a method for improving the above-described method which uses the rubber blade, there is one which employs a porous body for a wiping member, such as a cleaning roller or cleaning blade. For example, Japanese Unexamined Patent Application Publication No. 4-185450 and Japanese Patent No. 2738855 each disclose such method. Japanese Unexamined Patent Application Publication No. 4-185450 discloses a method of using a cleaning roller made from a porous body for cleaning an ejection surface. Japanese Patent No. 2738855 discloses a method of wiping an excess ink adhering to an ejection surface by using a cleaning blade made from a porous body.

The methods disclosed in Japanese Unexamined Patent Application Publication No. 4-185450 and Japanese Patent No. 2738855 each wipe out dusts while absorbing the ink according to capillarity of cells of the porous body by bringing the cleaning roller or blade of the porous body into contact with the ejection surface. With Japanese Unexamined Patent Application Publication No. 4-185450 and Japanese Patent No. 2738855, absorption of the ink and the dusts into the porous body may prevent the ink and the dusts from adhering to the ejection surface again, and from dispersing inside the device, thereby increasing cleaning effect.

However, according to the methods disclosed in Japanese Unexamined Patent Application Publication No. 4-185450 and Japanese Patent No. 2738855, sucking capability of the porous body is not sufficient for the ink thickened and solidified near the nozzles, which may cause nozzle clogging. Therefore, the thickened and solidified ink may not be removed completely, and may results in that the ink is not ejected or the ink is ejected in the deviated direction.

SUMMARY OF THE INVENTION

It is desirable to provide a liquid ejection device capable of absorbing excess liquid adhering to an ejection surface of a liquid ejection head to clean the ejection surface, and keeping ejection characteristics stable. Also, it is desirable to provide a liquid ejection device, in which the life of an absorbing member is extended by optimizing the absorption of liquid.

A liquid ejection device according to an embodiment of the present invention includes: a liquid ejection head which includes an ejection surface and an ejection port formed at the ejection surface, ejects a droplet of liquid from the ejection port, and allows the liquid to land on an object; an elastic absorbing member which comes into contact with the ejection surface of the liquid ejection head, and absorbs the liquid adhering to the ejection surface; and moving means for moving the absorbing member with respect to the ejection surface while the absorbing member is in contact with the ejection surface, in which the absorbing member has a surface layer which is impregnated with a solution containing a surfactant.

With this configuration, since the surface layer of the absorbing member for cleaning the ejection surface is impregnated with the solution containing the surfactant, the absorbing capability of absorbing the liquid increases, thereby providing high cleaning effect. Accordingly, the configuration can recover the ejection reliably, and can keep the ejection characteristics stable. In addition, with this configuration, since only the surface layer of the absorbing member is impregnated with the solution containing the surfactant, the configuration would not absorb the liquid excessively, thereby extending the life of the absorbing member.

DESCRIPTION OF THE PREFERRED EMBODIMENTS

Figure 1:
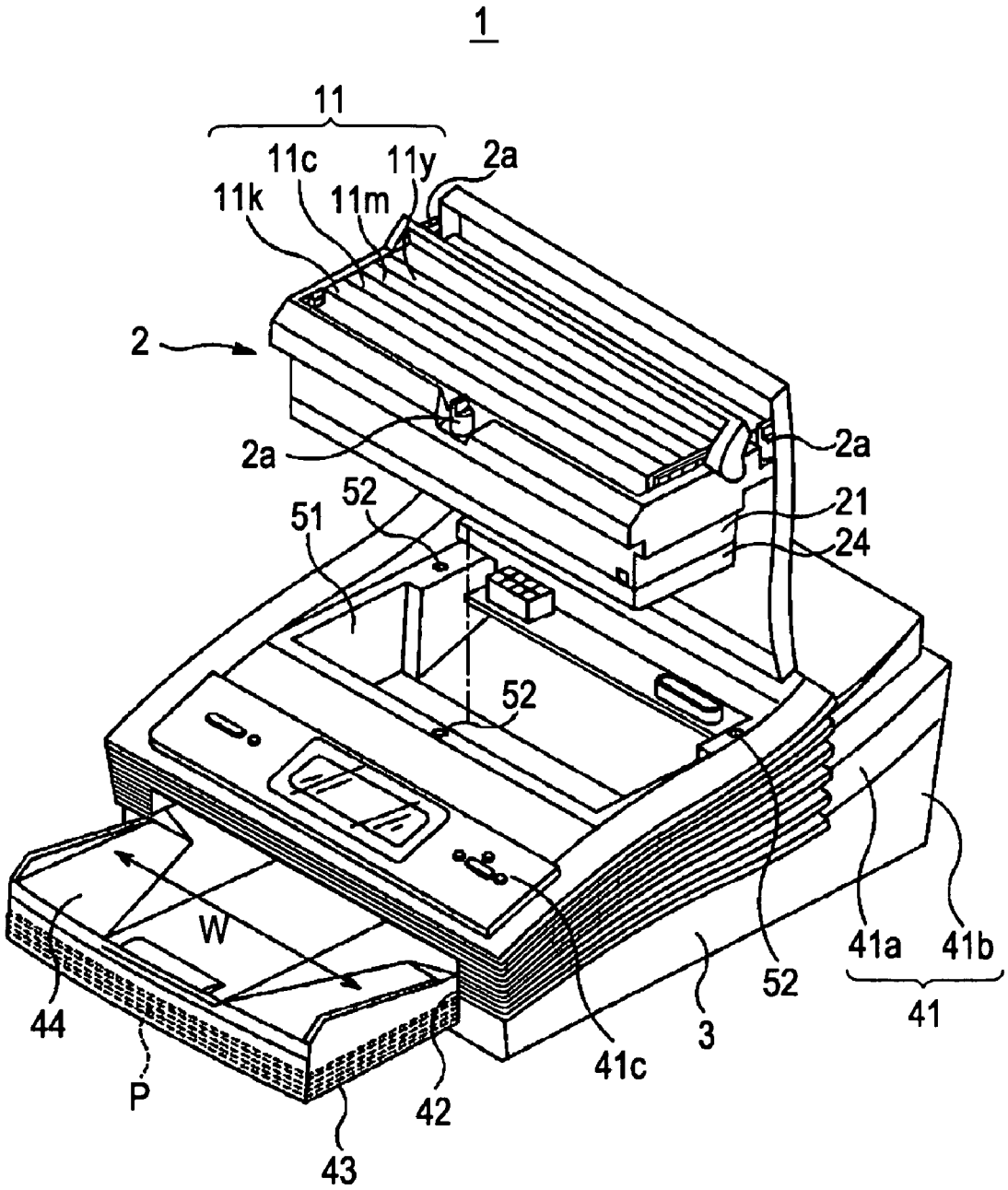
FIG. 1 is an exploded perspective view showing a liquid ejection device with an embodiment of the present invention applied.

An ink-jet printer (hereinafter, referred to as a printer) 1 with the present invention applied will be described below in detail. As shown in FIG. 1, the printer 1 prints images and characters on a recording sheet P, such as paper by ejecting liquid, for instance, ink i. The printer 1 includes a head cartridge 2 which ejects the ink i, and a device body 3 on which the head cartridge 2 is mounted. The printer 1 is a so-called line-type printer, in which ink ejection ports (nozzles) are arranged in lines for colors, respectively, in a width direction of the recording sheet P, namely, in an arrow W direction shown in FIG. 1. In the printer 1, the head cartridge 2 may be detachably attached to the device body 3.

Figure 2:
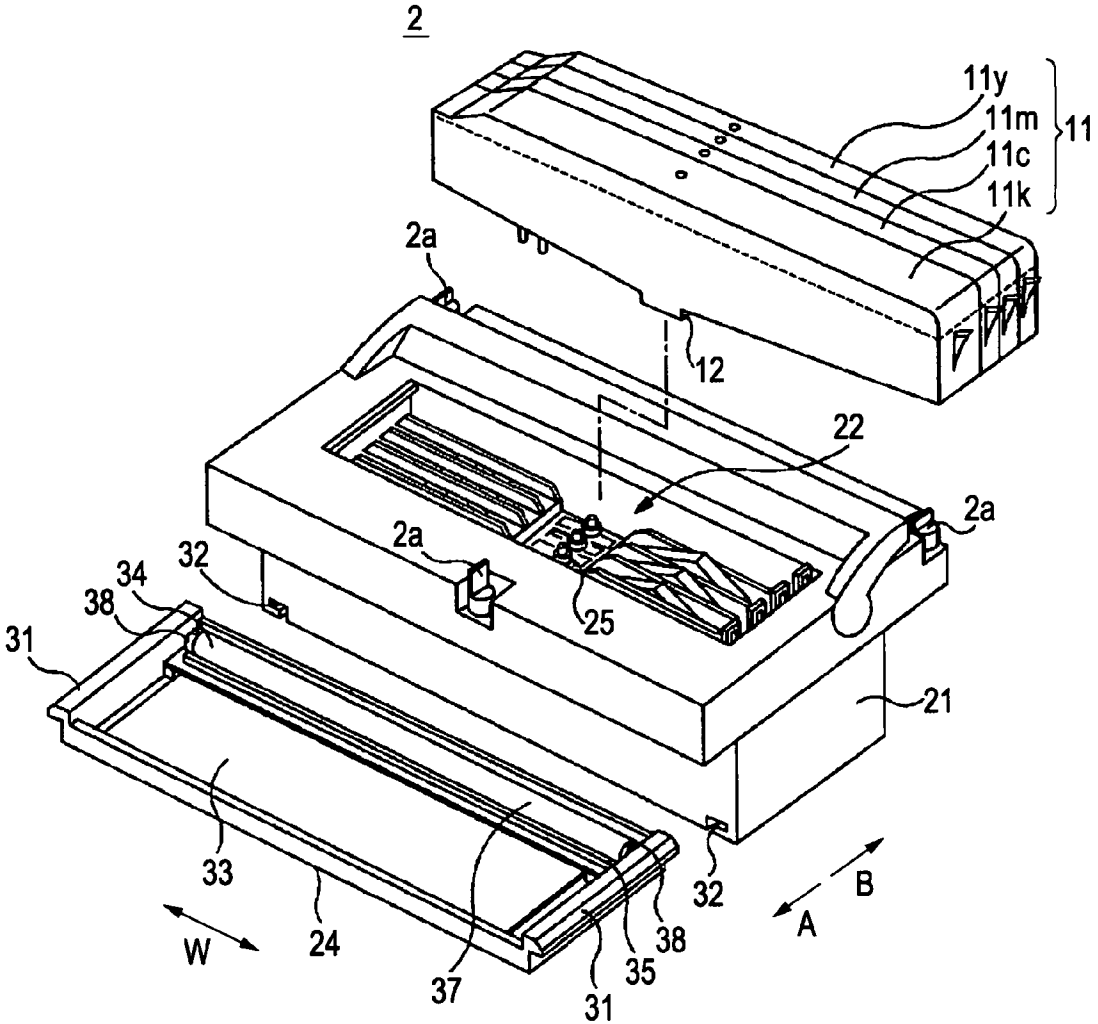
FIG. 2 is an exploded perspective view showing a head cartridge provided at the liquid ejection device.
Figure 3:
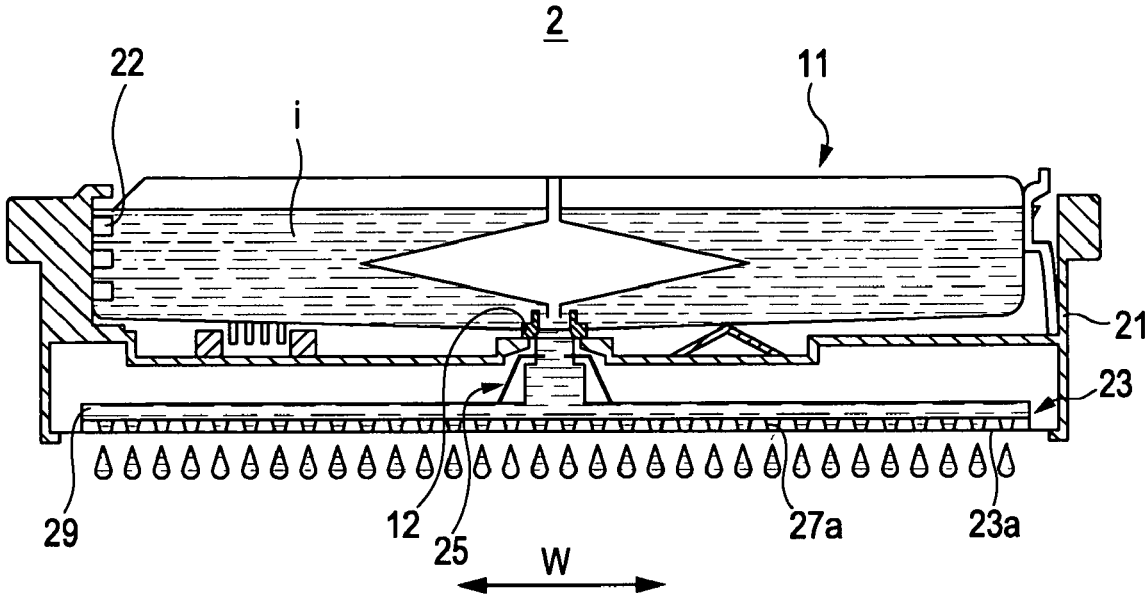
FIG. 3 is a cross sectional view showing the head cartridge.

The head cartridge 2 of the printer 1 is described. The head cartridge 2 uses, for instance, a heating resistor of electrothermal transducer system as a pressure-generating element to eject the ink i, so that the ink i is allowed to land on a principal surface of the recording sheet P. As shown in FIGS. 2 and 3, an ink tank section 11, in which the ink i is stored, is mounted on the head cartridge 2. The ink tank section 11 includes a yellow ink tank 11*y*, a magenta ink tank 11*m*, a cyan ink tank 11*c*, and a black ink tank 11*k*, for a yellow ink, a magenta ink, a cyan ink, and a black ink, respectively.

The ink tank section 11 is formed in a rectangular shape having substantially the same dimension as that of the recording sheet P in the width direction (the arrow W direction shown in FIG. 2). The ink tank section 11 is provided with an ink supply section 12 for supplying the ink i stored substantially at the center of a bottom surface of the ink tank section 11, to the head cartridge 2. The ink supply section 12 has a substantially protruding nozzles, and tip ends of the nozzles are fitted to a connection part 25 (described later) of the head cartridge 2. The ink tank section 11 is connected to the head cartridge 2 by fitting the ink supply section 12 to the connection part 25 of the head cartridge 2, so that the ink i can be supplied to the head cartridge 2. Alternatively, the ink tank section 11 may be integrally formed with the head cartridge 2.

As shown in FIGS. 2 and 3, the head cartridge 2 on which the ink tank section 11 is mounted includes a cartridge body 21. The cartridge body 21 includes a mounting part 22 on which the ink tank section 11 is mounted, an ink ejection head 23 which serves as a liquid ejection head for ejecting the ink i, and a head cap 24 which protects the ink ejection head 23.

The connection part 25 is provided substantially at the center in a longitudinal direction of the mounting part 22. The connection part 25 is connected to the ink supply section 12 of the ink tank section 11 mounted on the mounting part 22. The connection part 25 serves as an ink supply channel through which the ink i is supplied from the ink supply section 12 of the ink tank section 11 mounted on the mounting part 22 to the ink ejection head 23 provided on the bottom surface of the cartridge body 21 for ejecting the ink i. The connection part 25 controls the supply of the ink i supplied from the ink tank section 11 to the ink ejection head 23, by way of a valve mechanism.

The ink ejection head 23, to which the ink i is supplied from the connection part 25, is disposed along the bottom surface of the cartridge body 21. In the ink ejection head 23, nozzles 27*a* (described later), which serve as ejection ports for ejecting the ink i supplied from the connection part 25, are arranged in the width direction of the recording sheet P, namely, in the arrow W direction shown in FIG. 3, in lines for the four-color inks i, respectively. When ejecting the ink i, the ink ejection head 23 ejects the ink i in accordance with the nozzle lines, without moving in the width direction of the recording sheet P. Therefore, the printer 1 provides faster printing speed than that provided by a serial-type printer in which nozzles move in the width direction of the recording sheet P (the arrow W direction) for printing.

As shown in FIG. 4, the ink ejection head 23 includes a circuit board 26 provided with a heating resistor 26*a* of the electrothermal transducer system, a nozzle sheet 27 in which the nozzles 27*a* with a diameter of about 12 to 17 μm are formed, and a film 28 provided between the circuit board 26 and the nozzle sheet 27. In the ink ejection head 23, the ink i supplied from the connection part 25 is supplied through an ink flow channel 29 to an ink liquid chamber 30, which is surrounded and formed by the circuit board 26, the nozzle sheet 27, and the film 28. In the ink liquid chamber 30, the heating resistor 26*a* causes pressure to the ink i. The ink flow channel 29 extends along the arrangement direction of the nozzles 27*a*, namely, in the arrow W direction shown in FIG. 3. The ink liquid chamber 30 is provided for each heating resistor 26*a*. In the ink ejection head 23, the ink i flows from the ink tank section 11 into the ink flow channel 29 through the connection part 25 of the head cartridge 2, and is supplied to each ink liquid chamber 30 from the ink flow channel 29.

Figure 4A:
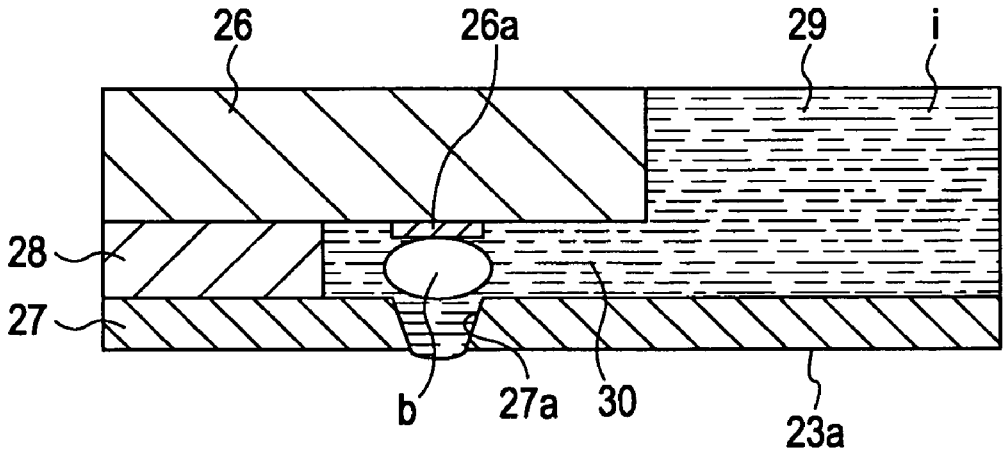
FIG. 4A is a cross sectional view schematically showing an ink ejection head in a state where an air bubble is generated at a heating resistor.
Figure 4B:
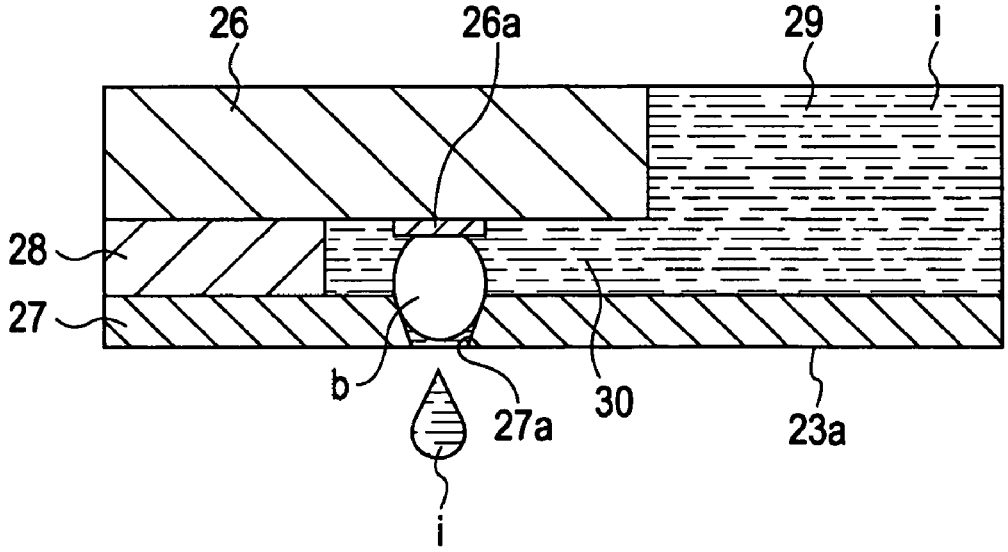
FIG. 4B is a cross sectional view schematically showing the ink ejection head in a state where ink is ejected from a nozzle.

The ink ejection head 23 having the above-described configuration applies pulsed current, for instance, at an interval of about 1 to 3 microseconds, to the heating resistor 26*a* selected based on print data. The heating resistor 26*a* is rapidly heated due to the applied current. As shown in FIG. 4A, in the ink ejection head 23, an air bubble b is generated in the ink i being in contact with the heated heating resistor 26*a*. Then, as shown in FIG. 4B, in the ink ejection head 23, the air bubble b expands and applies pressure to the ink i, so that the pressured ink i becomes a droplet, and is ejected from the nozzle 27*a*. After the droplet of ink i is ejected, additional ink i is supplied to the ink liquid chamber 30 through the ink flow channel 29, and the state of the ink liquid chamber 30 is restored to a pre-ejection state. In the ink ejection head 23, the above-described operation is repeated to continuously eject the ink i based on the print data.

Figure 5:
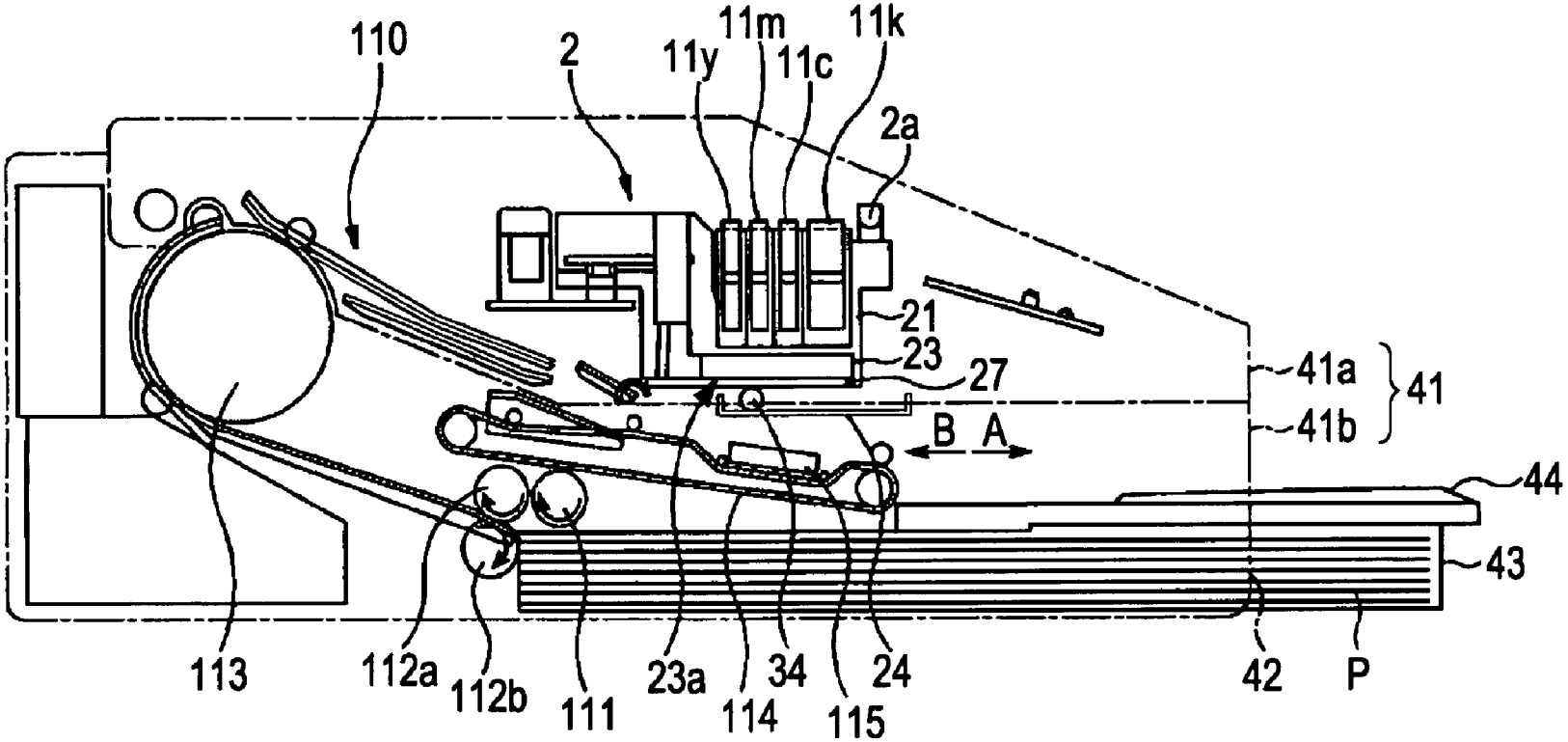
FIG. 5 is a perspective lateral view showing a part of a printer while a head cap is in an open state.

As shown in FIGS. 2 and 5, the head cap 24 for protecting an ejection surface 23*a*, which is provided with the nozzles 27*a*, of the ink ejection head 23 is provided at the bottom surface of the head cartridge 2, so as to protect the ink i in the nozzles 27*a* from being dried, and the like. As shown in FIG. 2, the head cap 24 has a size capable of covering the bottom surface of the head cartridge 2, and is formed substantially in a box shape with a side facing the bottom surface of the head cartridge 2 opened. The head cap 24 can move in arrow A and arrow B directions shown in FIG. 2. When the ink i is not ejected, cover protection pieces 31 provided at both ends in a short-axis direction of the head cap 24 are engaged with guide grooves 32 provided in the bottom surface of the head cartridge 2, and the head cap 24 is held at the bottom surface of the head cartridge 2. On the other hand, when the ink i is ejected, the cover protection pieces 31 move along the guide grooves 32 so that the nozzles 27*a* are exposed to the outside, and move from the bottom surface of the head cartridge 2, in the arrow A direction shown in FIG. 2, namely, to a front side of the device body 3 as shown in FIG. 5.

The head cap 24 serves as a receiver for the ink i dropped from the nozzles 27*a*, and for the preparatorily ejected ink i, while the head cap 24 is held by the bottom surface of the head cartridge 2 and closes the ejection surface 23*a*. In the head cap 24, an ink reception member 33 for receiving the ink i dropped from the nozzles 27*a* and the preparatorily ejected ink i is disposed. The ink reception member 33 may be a hygroscopic sponge or the like. In the head cap 24, the ink reception member 33 absorbs the ink i dropped from the nozzles 27*a* and the preparatorily ejected ink i.

Figure 6:
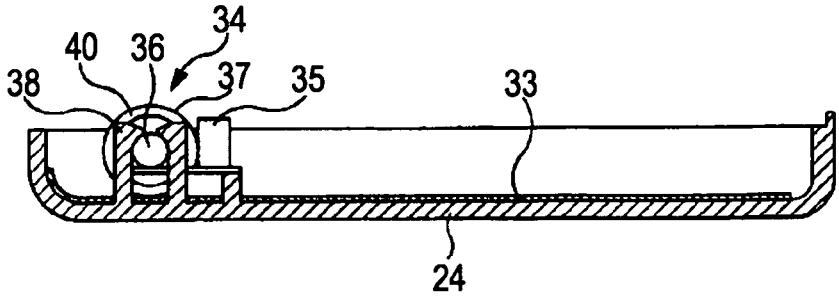
FIG. 6 is a cross sectional view showing the head cap.

As shown in FIG. 6, a cleaning roller 34 and a scraper 35 are attached in the head cap 24. The cleaning roller 34 serves as an absorbing member for absorbing the ink i and dusts adhering to the ejection surface 23*a*, the ink i thickened and solidified by drying, and the thickened and solidified ink i at the tip ends of the nozzles 27*a*, when the head cap 24 moves from the bottom surface of the head cartridge 2. The scraper 35 removes the dusts and the like adhering to a surface of the cleaning roller 34. When the head cap 24 moves from the bottom surface of the head cartridge 2, the cleaning roller 34 moves together with the head cap 24 and absorbs the ink i, the dusts, and the like, adhering to the ejection surface 23*a* while being rotated on the ejection surface 23*a*. Alternatively, the cleaning roller 34 may absorb the ink i, the dusts, and the like, adhering to the ejection surface 23*a*, when the head cap 24 is restored to the bottom surface of the head cartridge 2.

Figure 7:
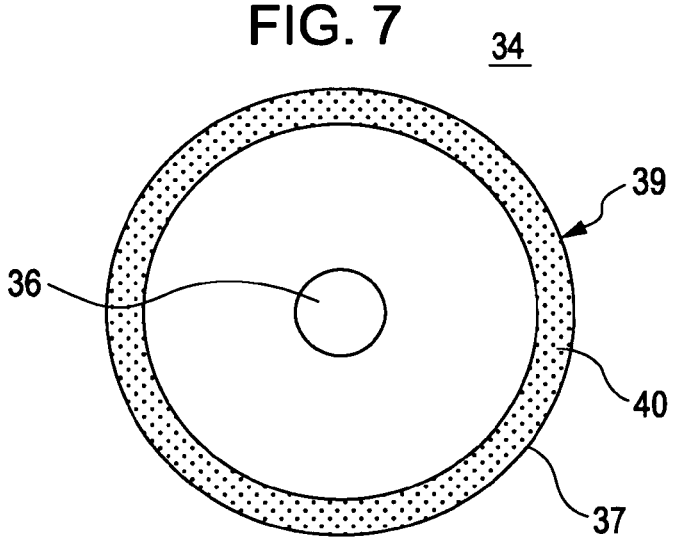
FIG. 7 is a lateral view showing a cleaning roller.

As shown in FIG. 7, the cleaning roller 34 includes a substantially cylindrical rod-shaped rotation shaft 36, and an absorbent 37 provided around the rotation shaft 36. The cleaning roller 34 cleans the ejection surface 23*a* by absorbing mist of the ink i ejected together with the droplet of ink i ejected from the nozzles 27*a*, the thickened and solidified ink i at the opening ends of the nozzles 27*a* because the ink i in the nozzles 27*a* is dried, and the dusts and the like adhering to the ejection surface 23*a*. In order to increase absorbing capability for the ink i, the dusts, and the like, a surface layer 39 (described below) of the cleaning roller 34 is impregnated with a solution containing a surfactant.

The rotation shaft 36 has a longer length in its axial direction than that of the nozzle line, in which the nozzles 27*a* are arranged in lines on the ejection surface 23*a* in the arrow W direction shown in FIG. 2, i.e., in the width direction of the recording sheet P. As shown in FIG. 6, a shaft of the rotation shaft 36 is rotatably supported by a supporting part 38 provided at the head cap 24.

Figure 8:
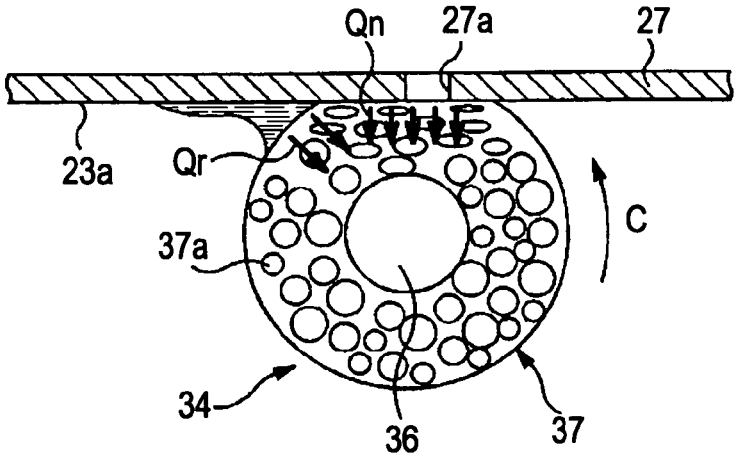
FIG. 8 is a cross sectional view showing a state where the cleaning roller absorbs the ink.

The absorbent 37 is an elastically deformable, porous body capable of absorbing the ink i, such as a sponge, felt, or open-cell organic resin porous body, as shown in FIG. 8. Such an open-cell organic resin porous body may employ various resin foam, such as polyethylene, polyurethane, polyolefin, melamine, or polyvinyl alcohol. Pores 37*a* are formed in the absorbent 37 and have a diameter of about 15 μm, to be smaller than an interval of 42.3 μm of the nozzles 27*a*, which are disposed at a pitch of 600 dpi (about 42.3 μm) on the ejection surface 23*a*.

The absorbent 37 preferably has its porosity in a range of from 60% to 90%. When the porosity is above 90%, mechanical strength of the absorbent 37 may be seriously deteriorated. On the other hand, when the porosity is below 60%, a space for holding the absorbed ink i becomes too small; thereby deteriorating cleaning ability. Therefore, determining the porosity of the absorbent 37 in the range of from 60% to 90% may provide excellent mechanical strength, and prevent decrease in the cleaning ability.

Herein, the absorbent 37 with the porosity of 80±3% is used as described below. This porosity within the above-stated range (from 60% to 90%) shows good performance, and the porosity of 80±3% is the most appropriate for providing the above-mentioned physical characteristics (absorbing capability and mechanical strength) in correlation with manufacturing costs. The porosity is obtained from a variation between a weight of the absorbent 37 before the pores are formed, and a weight thereof after the pores are formed. "±3%" is regarded as a manufacturing error.

As shown in FIG. 2, the absorbent 37 is formed to be longer than a dimension of an area where the nozzles 27*a* are formed on the ejection surface 23*a*, namely, a dimension of the recording sheet P in the width direction (the arrow W direction). When cleaning the ejection surface 23*a*, the absorbent 37 comes into contact with the ejection surface 23*a*, and is pressed to the ejection surface 23*a*, so as to clean the ejection surface 23*a* by absorbing the excess ink i adhering to the ejection surface 23*a*, the thickened and solidified ink i in the nozzles 27*a*, the dusts, and the like, according to the capillarity.

The cleaning roller 34 with such configuration has a part 40 impregnated with a solution containing a surfactant, at the surface layer 39 as shown in FIG. 7, in order to increase the absorbing capability. In the cleaning roller 34, since the surface layer 39 is impregnated with the solution containing the surfactant, when the cleaning roller 34 comes into contact with the ink i adhering to the ejection surface 23*a*, wettability of the surface layer 39, which comes into contact with the ink i, increases, and the ink i has an affinity to the solution. Therefore, the absorbing capability may increase.

The solution impregnated to the surface layer 39 is prepared by adding a predetermined amount of the surfactant into a nonvolatile solution, water, or the like. The maximum content of the surfactant is 4.56 wt %. Even when the content is less than 4.56 wt %, the surface layer 39 of the cleaning roller 34 may still hold the wettability, and the ink i may have an affinity to the solution containing the surfactant. The solution has substantially the same composition as that of the ink i when pigments and additives, such as a mildewcide, are excluded from the ink i.

In addition, the nonvolatile solution may be a solution having a vapor pressure lower than that of water, for instance, a vapor pressure lower than or equal to 0.1 mmHg at 20° C. When a solution having a vapor pressure higher than 0.1 mmHg at 20° C. is used, the solution may be volatilized from the absorbent 37. Therefore, it may be difficult to increase the wettability of the surface layer 39 of the cleaning roller 34. Examples of the nonvolatile solution include glycol solutions, such as ethylene glycol, diethylene glycol, and triethylene glycol; diol solutions, such as propylene glycol, hexylene glycol, and 1,3-butanediol; and glycol solutions, such as diethylene glycol monohexyl ether, diethylene glycol monobutyl ether, and triethylene glycol monobutyl ether. These may be used alone or in combination. In particular, it is preferable to use the glycol solutions, such as diethylene glycol monobutyl ether, and triethylene glycol monobutyl ether.

The surfactant contained in the solution may be prepared by mixing at least one of an ether, such as a polyoxyethylene alkyl ether or a polyoxyethylene alkyl phenyl ether; an ester, such as a polyoxyethylene fatty acid ester; a polyoxyethylene-polyoxypropylene copolymer; and a nitrogen-containing compound, such as a polyoxyethylene alkyl amine ether or a fatty acid diethanolamide, with a polyoxyethylene acetylene glycol.

The part 40 impregnated with the solution has a depth in a range of from 3.7 to 226.2 μm from the surface of the cleaning roller 34. When the depth of the part 40 impregnated with the solution containing the surfactant is less than 3.7 μm, the amount of the solution impregnated into the cleaning roller 34 is too small. Therefore, the wettability of the surface layer 39 of the cleaning roller 34, which comes into contact with the ink i, may not be improved, the ink i may not have an affinity to the solution, and thus, the absorbing capability of the cleaning roller 34 may not increase. In the printer 1, poor absorbing capability for the ink i of the cleaning roller 34 may cause lines and color mixture to appear in the images.

On the other hand, when the depth of the part 40 impregnated with the solution containing the surfactant is more than 226.2 μm, the amount of the solution containing the surfactant is too large. Therefore, the ink i may be absorbed excessively, the absorption amount of the ink i may exceed the absorption capacity of the cleaning roller 34, and thus, color mixture may appear in the images and the life of the cleaning roller 34 may be shorten. In addition, when the depth of the part 40 impregnated with the solution is large, the absorption amount of the ink i increases. Therefore, the use amount of the ink i increases, and thus, the cost of the ink i increases.

Owing to this, determining the cleaning roller 34 to have the depth of the part 40 impregnated with the solution in the range of from 3.7 to 226.2 μm, may increase the wettability of the surface layer 39, which comes into contact with the ink i, the ink i may have an affinity to the solution, and thus, the absorbing capability for the ink i may increase. In addition, since the cleaning roller 34 is impregnated with the solution only by the depth in the range of from 3.7 to 226.2 μm from its surface, the ink i would not be absorbed excessively, but the thickened and solidified ink i and the like can be absorbed properly.

Figure 9:
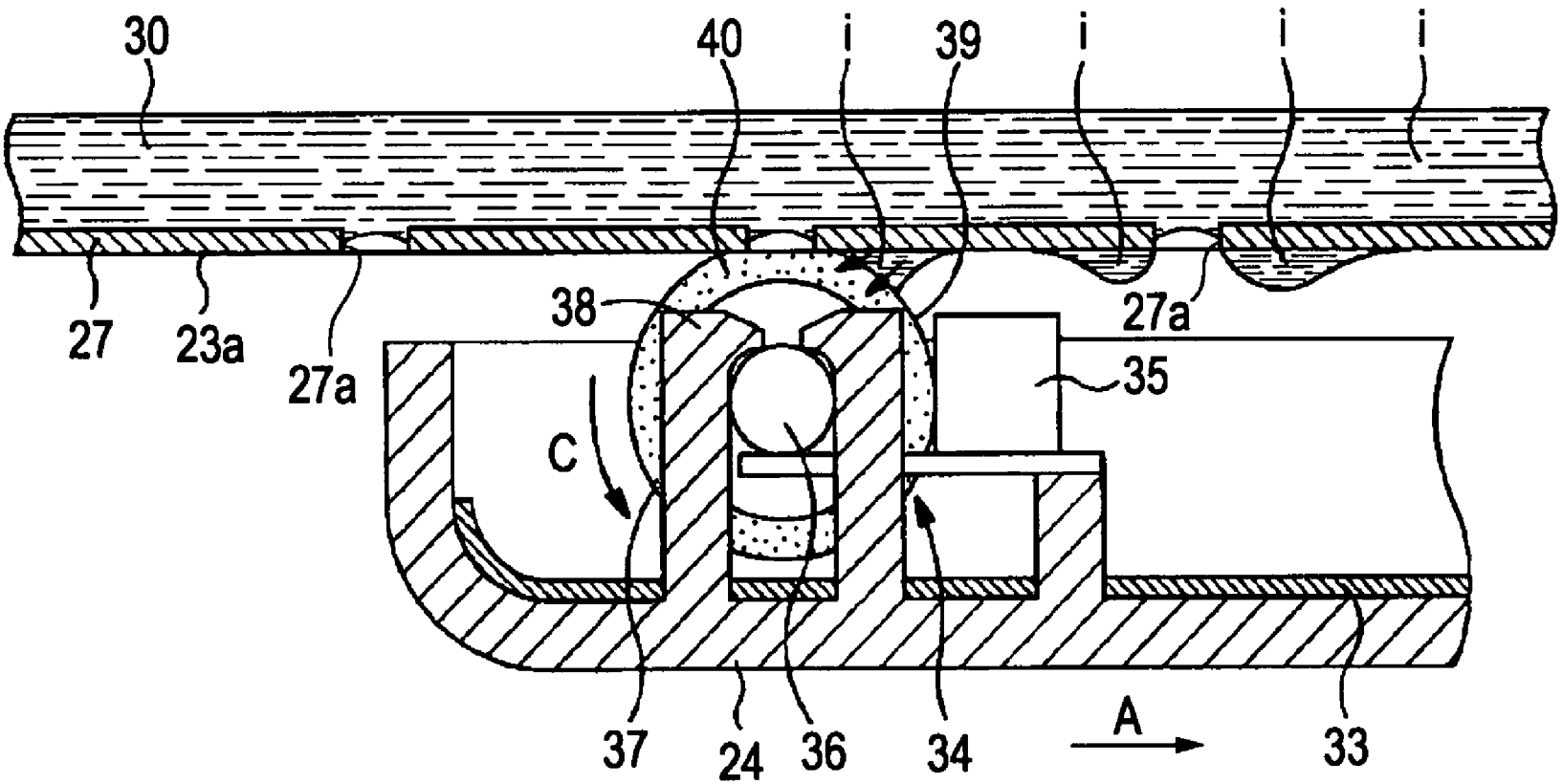
FIG. 9 is a cross sectional view showing a state where the cleaning roller cleans an ejection surface.

As shown in FIGS. 8 and 9, immediately before the ink i is ejected, namely, when the head cap 24 moves from the bottom surface of the head cartridge 2 to expose the ejection surface 23*a*, the cleaning roller 34 with the above-mentioned configuration moves on the ejection surface 23*a* in a direction opposite to the movement direction of the head cap 24 (the arrow A direction shown in FIG. 9), i.e., moves in an arrow C direction shown in FIG. 9 in a rotating manner, while being in contact with the ejection surface 23*a* at proper pressure over the full length of the ejection surface 23*a*. As shown in FIG. 8, when the cleaning roller 34 rotates on the ejection surface 23*a* at the proper pressure, the pores 37*a* at the pressured portion of the absorbent 37 are squeezed and the diameter of the pores 37*a* decreases. Therefore, the portion where the pores 37*a* are squeezed provides larger capillarity (Qn) than that of the portion where the pores 37*a* are not squeezed. Therefore, the ink i may be easily soaked into the pores 37*a*. In addition, since the cleaning roller 34 rotates on the ejection surface 23*a*, the squeezed pores 37*a* are restored to the original size at the portion where the pressure is released, thereby providing sucking capability (Qr). Thus, the rotation of the cleaning roller 34 on the ejection surface 23*a* in a pressing manner provides plural actions including the capillarity (Qn) of the pores 37*a* at the pressured portion and the sucking capability (Qr) of the pores 37*a* at the pressure-released portion. Accordingly, the thickened and solidified ink i adhering to the ejection surface 23*a*, the thickened and solidified ink i in the nozzles 27*a*, the dusts, and the like, may be absorbed to the pores 37*a*.

Further, since the surface layer 39 of the cleaning roller 34 is impregnated with the solution containing the surfactant, the wettability of the surface layer 39, which comes into contact with the ink i, may increase, and the ink i may have an affinity to the solution, so that the ink i is easily absorbed.

In addition, the cleaning roller 34 has the scraper 35 provided in the head cap 24 at the inner side of the cleaning roller 34, to have substantially the same length as that of the cleaning roller 34. The scraper 35 wipes out the crud of the ink i, the dusts, and the like, adhering to the surface of the cleaning roller 34, thereby preventing decrease in the absorbing capability.

Now, the upper limit 226.2 μm and the lower limit 3.7 μm of the depth impregnated with the solution containing the surfactant, and the maximum content 4.56 wt % of the surfactant in the solution are described.

In order to obtain the upper limit 226.2 μm, the lower limit 3.7 μm, and the maximum content 4.56 wt %, for instance, the following cleaning roller 34 may be used.

The material of the cleaning roller 34 used here is polyethylene, the mean pore diameter of the pores 37*a* is 15 μm, and the porosity of the cleaning roller 34 is 80±3%. The shape of the cleaning roller 34 is a crown, and the minimum diameter is 8.5 mm, the maximum diameter is 9.2 mm, and the effective length is 216.576 mm. In this case, the cleaning roller 34 is a cylinder with the diameter of 8.85 mm, which is the mean value of the minimum diameter 8.5 mm and the maximum diameter 9.2 mm.

The cleaning roller 34 corresponds to the ink ejection head 23 of the head cartridge 2 having 5120 nozzles 27*a* with a nozzle pitch of 600 dpi on the ejection surface 23*a*. When the cleaning roller 34 cleans the ejection surface 23*a*, a load in a range of from 650 to 850 g is applied to the cleaning roller 34. The width (nip width) of the cleaning roller 34, to be in contact with the ejection surface 23*a*, is in a range of from 1.0 to 1.5 mm. In this case, the nip width of the cleaning roller 34 is 1.25 mm, which is the mean value of the minimum width 1.0 mm and the maximum width 1.5 mm.

Figure 10:
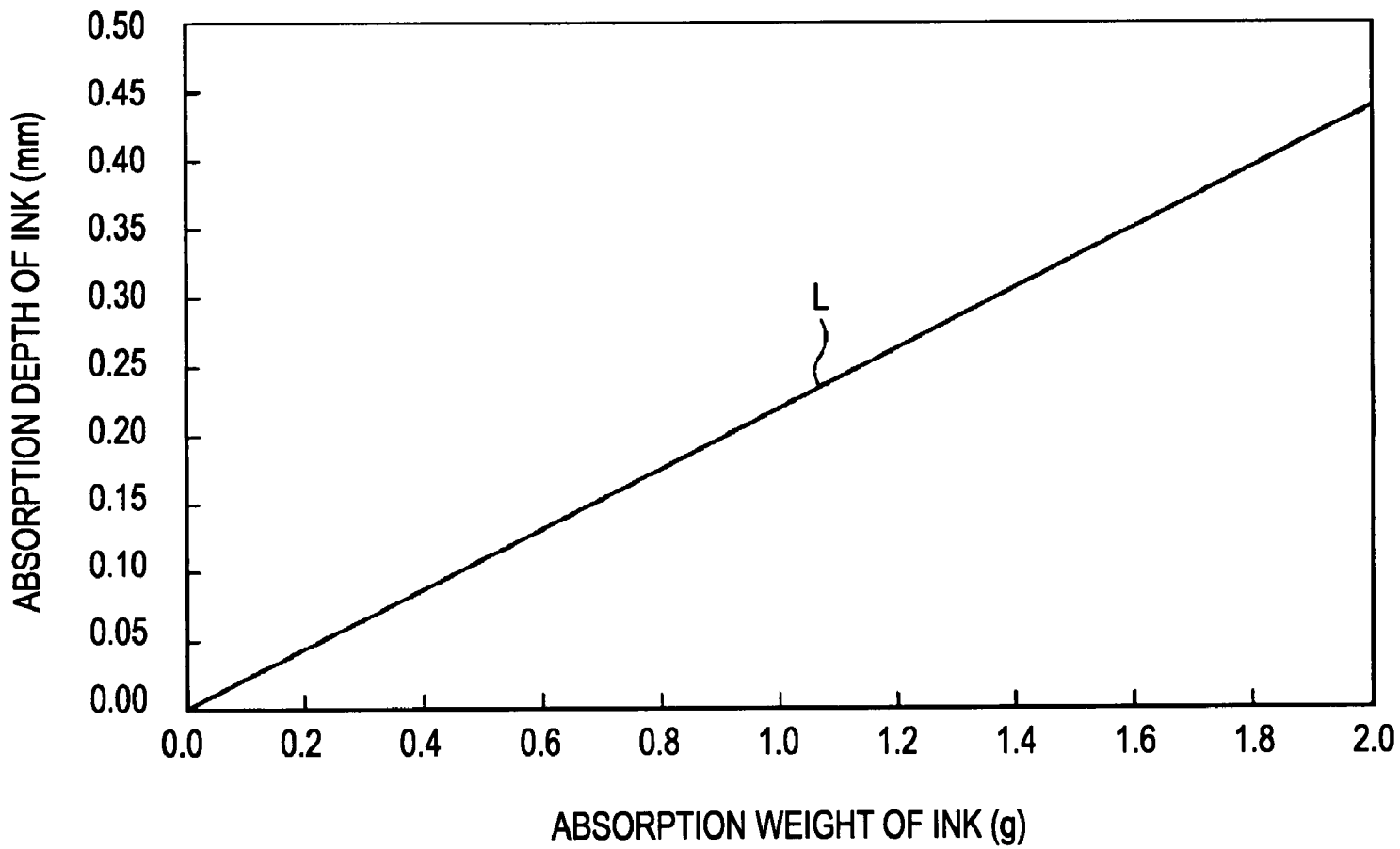
FIG. 10 is a graph showing relationship between an absorption weight and an absorption depth of the ink.

According to the cleaning roller 34 with the above-stated conditions, relationship between an absorption weight of the ink i, and a depth impregnated with the ink i by absorbing the ink i, namely, an absorption depth when the ink i is absorbed, shows a curved line L as shown in FIG. 10.

On the basis of that the density of the ink i is 1, when V (g) is a volume of the absorbed ink i, 80% is the porosity, $R_0$ (mm) is a radius of the cleaning roller, x (mm) is an absorption depth of the ink i, and d (mm) is the full length of the cleaning roller, the theoretical equation related to the curved line L is as follow:

(Equation 1)

since $$V=(\pi(R_0/10)^2-\pi(R_0/10-x/10)^2)\times d/10\times 0.8,$$

the following expression may be obtained:

$$x=R_0\pm\sqrt{(R_0^2-1000V/(0.8\times\pi\times d))}$$

herein, x=0 if V=0, therefore, $$x=R_0-\sqrt{(R_0^2-1000V/(0.8\times\pi\times d))}$$

Alternatively, the curved line L shown in FIG. 10 may show relationship between an impregnation weight and an impregnation depth of the solution impregnated into the surface layer 39 of the cleaning roller 34, since the solution containing the surfactant has substantially the same composition as that of the ink i.

Based on the relationship between the absorption weight and the absorption depth of the ink i absorbed into the cleaning roller 34 as shown in FIG. 10, printing was performed while the ejection surface 23*a* was actually cleaned, and then, the upper limit was determined to 226.2 μm in accordance with the obtained images and the evaluation results of the life of the cleaning roller 34.

In particular, the above-conditioned cleaning roller 34 absorbed the solution, which was prepared as the surfactant as shown in Chemical Formula 1 by adding 2,4,7,9-tetramethyl-5-decin-4,7,-diol-di(polyoxyethylene)ether with the content of 0.35 wt %; glycerin with the content of 9.0 wt %; 2-pyrrolidone with the content of 6.3 wt %; and water with the content of 84.35 wt %, and then, the cleaning roller 34 was dried in an oven set at 30° C. for 14 to 20 hours, so that the surface layer 39 was impregnated with the solution.

(Chemical Formula 1)

(Chemical Formula 1)

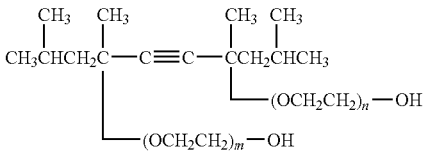

$m+n=10$ mol AV

An impregnation method of the solution into the cleaning roller 34 includes filling the ink ejection head 23 with the solution instead of the ink i, making the cleaning roller 34 rotate on the ejection surface 23*a*, and impregnating the cleaning roller 34 with the solution ejected from the nozzles 27*a*. The impregnation of the solution into the cleaning roller 34 by using the ink ejection head 23 allows the cleaning roller 34 to be substantially evenly impregnated with the solution over the surface of the cleaning roller 34.

The solution containing the surfactant was thus impregnated, so that samples 1 to 55, being different in the impregnation weight of the solution, were prepared. Each impregnation weight of the samples 1 to 55 was determined as shown in Tables 1 and 2.

TABLE 1

| Sample Number | Impregnation Weight (g) | Impregnation Depth (mm) (converted from weight) | Line in Image Immediately after Replacement | Color Mixture | Life of Roller Member |
|---|---|---|---|---|---|
| 1 | 0.0000 | 0.0000 | x | x | ○ |
| 2 | 0.3120 | 0.0652 | ○ | ○ | ○ |
| 3 | 0.3850 | 0.0807 | ○ | ○ | ○ |
| 4 | 0.5040 | 0.1059 | ○ | ○ | ○ |
| 5 | 0.5490 | 0.1155 | ○ | ○ | ○ |
| 6 | 0.6020 | 0.1268 | ○ | ○ | ○ |
| 7 | 0.6130 | 0.1291 | ○ | ○ | ○ |
| 8 | 0.6240 | 0.1315 | ○ | ○ | ○ |
| 9 | 0.6470 | 0.1364 | ○ | ○ | ○ |
| 10 | 0.6510 | 0.1373 | ○ | ○ | ○ |
| 11 | 0.6590 | 0.1390 | ○ | ○ | ○ |
| 12 | 0.6630 | 0.1398 | ○ | ○ | ○ |
| 13 | 0.6760 | 0.1426 | ○ | ○ | ○ |
| 14 | 0.6900 | 0.1456 | ○ | ○ | ○ |
| 15 | 0.6910 | 0.1458 | ○ | ○ | ○ |
| 16 | 0.7040 | 0.1486 | ○ | ○ | ○ |
| 17 | 0.7050 | 0.1489 | ○ | ○ | ○ |
| 18 | 0.7060 | 0.1491 | ○ | ○ | ○ |
| 19 | 0.7140 | 0.1508 | ○ | ○ | ○ |
| 20 | 0.7200 | 0.1521 | ○ | ○ | ○ |
| 21 | 0.7360 | 0.1555 | ○ | ○ | ○ |
| 22 | 0.7360 | 0.1555 | ○ | ○ | ○ |
| 23 | 0.7420 | 0.1568 | ○ | ○ | ○ |
| 24 | 0.7560 | 0.1598 | ○ | ○ | ○ |
| 25 | 0.7630 | 0.1613 | ○ | ○ | ○ |
| 26 | 0.7730 | 0.1635 | ○ | ○ | ○ |
| 27 | 0.7760 | 0.1641 | ○ | ○ | ○ |
| 28 | 0.8100 | 0.1715 | ○ | ○ | ○ |

TABLE 2

| Sample Number | Impregnation Weight (g) | Impregnation Depth (mm) (converted from weight) | Line in Image Immediately after Replacement with New One | Color Mixture | Life of Roller Member |
|---|---|---|---|---|---|
| 29 | 0.8100 | 0.1715 | ○ | ○ | ○ |
| 30 | 0.8260 | 0.1749 | ○ | ○ | ○ |
| 31 | 0.8310 | 0.1760 | ○ | ○ | ○ |
| 32 | 0.8320 | 0.1762 | ○ | ○ | ○ |
| 33 | 0.9100 | 0.1931 | ○ | ○ | ○ |
| 34 | 1.0500 | 0.2236 | ○ | ○ | ○ |
| 35 | 1.0620 | 0.2262 | ○ | ○ | ○ |
| 36 | 1.4150 | 0.3042 | ○ | Δ | Δ |
| 37 | 1.8160 | 0.3946 | ○ | x | x |
| 38 | 2.1250 | 0.4656 | ○ | x | x |
| 39 | 4.3620 | 1.0240 | ○ | x | x |
| 40 | 4.7220 | 1.1227 | ○ | x | x |
| 41 | 4.8030 | 1.1453 | ○ | x | x |
| 42 | 4.8070 | 1.1464 | ○ | x | x |
| 43 | 5.1330 | 1.2390 | ○ | x | x |
| 44 | 5.3900 | 1.3140 | ○ | x | x |
| 45 | 6.1880 | 1.5593 | ○ | x | x |
| 46 | 6.2560 | 1.5812 | ○ | x | x |
| 47 | 6.5270 | 1.6701 | ○ | x | x |
| 48 | 6.6270 | 1.7037 | ○ | x | x |
| 49 | 6.8210 | 1.7700 | ○ | x | x |
| 50 | 8.5030 | 2.4352 | ○ | x | x |

TABLE 2-continued

| Sample Number | Impregnation Weight (g) | Impregnation Depth (mm) (converted from weight) | Line in Image Immediately after Replacement with New One | Color Mixture | Life of Roller Member |
|---|---|---|---|---|---|
| 51 | 8.5180 | 2.4422 | ○ | x | x |
| 52 | 8.5880 | 2.4749 | ○ | x | x |
| 53 | 8.6060 | 2.4834 | ○ | x | x |
| 54 | 8.7170 | 2.5366 | ○ | x | x |
| 55 | 8.7690 | 2.5621 | ○ | x | x |

Note that the curved line L shown in FIG. 10 may be concerned as the relationship between the impregnation weight and the impregnation depth of the solution, since the solution containing the surfactant has substantially the same composition as that of the ink i. Accordingly, each impregnation depth of the solution shown in Tables 1 and 2 was derived from the impregnation weight of the solution according to the curved line L, namely, according to the theoretical equation of the curved line L.

Each sample of the cleaning rollers 34 were evaluated, when a first sheet was printed immediately after the cleaning roller 34 was replaced with new one, for the presence of the lines and the color mixture in the images of first printing sheets, and for the life of the cleaning roller 34. An evaluation method includes printing an image in a wide area of the recording sheet P by using the ink ejection head 23 with the four-color-nozzle lines of yellow, magenta, cyan, and black; and cleaning the ejection surface 23*a* with the cleaning roller 34 each time when printing is performed on a sheet. The evaluation results are shown in Tables 1 and 2.

Regarding the evaluation for the appearance of the lines in the images immediately after the cleaning roller 34 was replaced with new one, a cross sign represents that the lines appeared, and a circle sign represents that the lines did not appear.

Regarding the evaluation for the color mixture during the continuous printing, a circle sign was given if the color mixture did not appear even when more than 1000 sheets were printed, a triangle sign was given if the color mixture appeared when 700 to 1000 sheets were printed, and a cross sign was given if the color mixture appeared when less than 700 sheets were printed.

Regarding the evaluation for the life of the cleaning roller 34 during the continuous printing, in Table 1, a circle sign was given if the ink i did not overflow from the cleaning roller 34 even when more than 1000 sheets were printed, a triangle sign was given if the ink i overflowed when 700 to 1000 sheets were printed, and a cross sign was given if the ink i overflowed when less than 700 sheets were printed.

As shown in the evaluation results shown in Table 1, the sample 1, in which the surface layer 39 was not impregnated with the solution containing the surfactant, was difficult to absorb the ink i adhering to the ejection surface 23*a* and the thickened and solidified ink i in the nozzles 27*a*, and the ink i could not be ejected properly due to the thickened and solidified ink i in the nozzles 27*a*. This caused the lines to appear in the images immediately after the cleaning roller 34 was replaced with new one. Hence, the sample 1 could not absorb the ink i in the early operation state of the cleaning. In addition, in the sample 1, the ejected ink i was mixed with the ink i of other color adhering to the ejection surface 23*a*; causing the color mixture to appear.

In each of the samples 36 to 55, since the impregnation weight of the solution containing the surfactant was more than or equal to 1.415 g, which was large, the absorption amount of the ink i was large; causing the ink i to overflow from the cleaning roller 34. In addition, in each of the samples 36 to 55, the ink i overflowed from the cleaning roller 34 caused the color mixture.

In contrast, as compared to the samples 1 and samples 36 to 55, the evaluations on the images for the lines, the color mixture, and the life of the cleaning roller 34 right after the replacement with new one were all satisfactory for each of the samples 2 to 35.

In each of the samples 2 to 35, the impregnation weight of the solution is in a range of from 0.312 to 1.062 g, and the impregnation depth of the solution from the surface of the cleaning roller 34 is in a range of from 0.0652 to 0.2262 mm. Hence, in the samples 2 to 35, since the impregnation amount of the solution is proper, the ink i would not be absorbed excessively, but the excess ink i adhering to the ejection surface 23*a* and the thickened and solidified ink i in the nozzles 27*a* may be absorbed, thereby reliably removing such ink i from the ejection surface 23*a*. As shown in the case of the sample 35, the cleaning roller 34 can properly clean the ejection surface 23*a* by impregnating the cleaning roller 34 with the solution from the surface thereof to the depth of 0.2262 mm (226.2 μm). In the cleaning roller 34, the upper limit of the depth of the part 40 impregnated with the solution may be determined to 226.2 μm.

In addition, the cleaning roller 34 is preferable to have the capability of absorbing the excess ink i adhering to the ejection surface 23*a* and the thickened and solidified ink i in the nozzles 27*a* so that at least the lines and the color mixture do not appear in the images in printing. Therefore, the lower limit of the depth of the part 40 impregnated with the solution was determined to 3.7 μm, on account of the evaluations of the images obtained after the ejection surface 23*a* is actually cleaned in printing. The reason why the lower limit is determined on account of the evaluation results of the obtained images through the actual printing with the use of the ink i is that, according to the above-described method for evaluating the images and the life of the cleaning roller 34 by making the cleaning roller 34 absorb the solution, it is difficult to evenly absorb the solution over the surface of the cleaning roller 34 if the impregnation amount of the solution impregnated into the cleaning roller 34, namely, the impregnation weight of the solution is less than 0.312 g, as shown in the case of the sample 2.

Accordingly, if it is possible to determine the minimum absorption amount of the ink i which is necessary to be absorbed for keeping the image quality high without the lines in the actual printing, the absorption depth of the ink i can be calculated based on the conditions of the nip width, the effective length, and the porosity of the cleaning roller 34. Since the calculated absorption depth represents the depth to which the ink i is necessary to be absorbed into the cleaning roller 34, the impregnation of the solution by that depth allows the ink i to be absorbed effectively. Therefore, the calculated depth may be recognized as the depth to which the solution is impregnated, namely, the depth of the part 40 impregnated with the solution.

In particular, the cleaning rollers 34 to be used for the comparison may be the samples 56 to 58 as shown in Table 3. The sample 56 is the cleaning roller 34 in which the surface layer 39 is impregnated with the solution in the same manner to the sample 8 shown in Table 1. The sample 57 is the cleaning roller 34 in which the surface layer 39 is impregnated with the solution in the same manner to the sample 23 shown in Table 1. The sample 58 is the cleaning roller 34 which is not treated, i.e., the surface layer 39 is not impregnated with the solution.

Using these samples, the printing and the cleaning of the ejection surface 23*a* were performed as follow. First, using the inks i of yellow, magenta, cyan, and black, printing was performed in a wide area of the recording sheet P by using the ink ejection head 23 with a nozzle pitch of 600 dpi, and the ejection surface 23*a* was cleaned with the cleaning roller 34 of each sample each time when one sheet printing is completed. The printing was performed on 100 sheets, and the cleaning was repeated for 100 times. After the 100 times of the cleaning operations, the absorption weight of the ink i was obtained from the variation in the weight of the cleaning roller 34. Table 3 shows the absorption weight. In addition, the obtained images were evaluated for the lines and the color mixture. In table 3, a circle sign was given if the lines or the color mixture did not appear in the images, and a cross sign was given if the lines and the color mixture appeared in the images.

TABLE 3

| | Absorption Weight of Ink (g) | | Presence of Line and |
|---|---|---|---|
| | Early State | 100 Times | Color Mixture |
| Sample 56 | 0.00 | 0.39 | ○ |
| Sample 57 | 0.00 | 0.31 | ○ |
| Sample 58 | 0.00 | 0.16 | x |

As shown in the results in Table 3, according to the samples 56 and 57, the lines or the color mixture did not appear, and the images with high quality were obtained. In contrast, according to the sample 58, the lines and the color mixture appeared in the images.

The absorption depth of the ink i for each of the samples 56 to 58 is obtained as follow. The sample 56 is explained as an example.

The absorption weight of the ink i which was absorbed when the cleaning roller 34 of the sample 56 performed cleaning for 100 times was 0.39 g. 0.39 g of the absorption weight of the ink i represents the absorption weight when four lines were cleaned for 100 times since the ink ejection head 23 employs the four-line head.

Therefore, a mean absorption weight (w) of the ink i per line for one cleaning operation is obtained as follow:

$$w = (\text{absorbtion weight for } 100-\text{time cleaning})/(100\times 4) = 0.39/400 = 1.0\times 10^{-3}\ (\text{g})$$

Since the density of the ink is 1, the absorption amount of the absorbed ink i becomes 1.0 μl, according to the obtained mean absorption weight (w). Therefore, the absorption amount of the ink i per line for the one cleaning operation is 1.0 μl.

The relation among the absorption amount of the ink i, the nip width of the cleaning roller 34, the effective length thereof, the impregnation depth of the ink i, namely, the absorption depth of the ink i, and the porosity may be expressed in an expression as follow:

$$(\text{absorption amount of ink } i) = (\text{nip width})\times(\text{effective length})\times(\text{absorption depth of ink } i)\times(\text{porosity})$$

Therefore, the absorption depth of the ink i may be expressed as follow:

$$(\text{absorption depth of ink } i) = (\text{absorption amount of ink } i)/\{(\text{nip width})\times(\text{effective length})\times(\text{porosity})\}.$$

According to this relational expression, the absorption depth of the ink i becomes a value as follow:

$$(\text{absorption depth}) = 1.0/\{(1.25)\times(216.576)\times(0.80)\} = 4.6(\mu\text{m})$$

When these calculations are adopted to the samples 57 and 58, the absorption amount and the absorption depth of the ink i per line for one cleaning operation becomes as follow as shown in Table 4:

TABLE 4

| | Absorption Per One Cleaning Operation | |
|---|---|---|
| | Absorption Amount of Ink (μl) | Absorption Depth of Ink (μm) |
| Sample 56 | 1.0 | 4.6 |
| Sample 57 | 0.8 | 3.7 |
| Sample 58 | 0.4 | 1.8 |

According to the results shown in Tables 3 and 4, in each case of the samples 56 and 57, since the image quality can be kept high, the thickened and solidified ink i in the nozzles 27*a* may be properly removed. Therefore, the minimum absorption amount of the ink i is 0.8 μl as in the case of the sample 57. Since the absorption depth of the ink i into the sample 57 is 3.7 μm, the image quality can be kept high if the ink i can be absorbed to this depth. In particular, if the wettability of the cleaning roller 34 with respect to the ink i is secured for the depth is 3.7 μm from its surface, 0.8 μl of the ink i, which is the minimum absorption amount necessary to be absorbed, can be absorbed. Therefore, the cleaning roller 34 is impregnated with the solution containing the surfactant by the depth of 3.7 μm from its surface.

On the other hand, in the case of the sample 58, since the lines and the color mixture appear in the images, the thickened and solidified ink i in the nozzles 27*a* are not satisfactory absorbed. The cleaning roller 34 which is not impregnated with the solution containing the surfactant may not absorb the thickened and solidified ink i sufficiently. Hence, the lower limit of the depth of the part 40 impregnated with the solution of the cleaning roller 34 is determined to 3.7 μm, which does not cause the lines or the color mixture in the images as shown in the case of the sample 57.

As described above, the depth of the part 40 impregnated with the solution of the surface layer 39 of the cleaning roller 34 is in the range of from 3.7 to 226.2 μm from the surface of the cleaning roller 34.

The depth of the part 40 impregnated with the solution is determined to 226.2 μm as the upper limit of the impregnation depth since the evaluation results of the experiments with this depth are preferable as shown in Tables 1 and 2, and determined to 3.7 μm as the lower limit of the impregnation depth of the solution to be impregnated since the evaluation results obtained by actually cleaning the ejection surface 23*a* are preferable. Therefore, the cleaning roller 34 with the porosity of 80%, without any other conditional restrictions, can clean the ejection surface 23*a* to keep the ejection characteristics stable, by determining the depth of the part 40 impregnated with the solution in the range of from 3.7 to 226.2 μm from the surface of the cleaning roller 34.

The maximum content of the surfactant contained in the solution which is impregnated into the cleaning roller 34 may be assumed as the amount necessary for evenly covering the whole surface of the pores 37*a* of the cleaning roller 34.

In particular, a molecularity (Mn) of the surfactant necessary for covering the whole surfaces of the pores 37*a* may be obtained by the following expression:

$$Mn=S/s$$

where S represents the total surface area of the pores 37*a* at the parts where the surfaces of the pores 37*a* are impregnated with the solution, and s represents a projected area when molecules of the surfactant are projected into an absorption plane.

The necessary maximum amount (W) of the surfactant may be obtained by the following expression:

$$W=Mn/Na\times M$$

where M is a molecular weight of the surfactant, and Na is an Avogadro's number.

The maximum content of the surfactant may be obtained by the following expression:

$$\text{(maximum content)}=W/W0\times 100$$

where W0 is a weight of the solution impregnated into the cleaning roller 34.

For example, in the case of the sample 4 shown in Table 1, in which the solution is impregnated into the cleaning roller 34 by the depth of 0.1059 mm, the total surface area (S) of the pores 37*a* may be obtained as follows.

Figure 11:
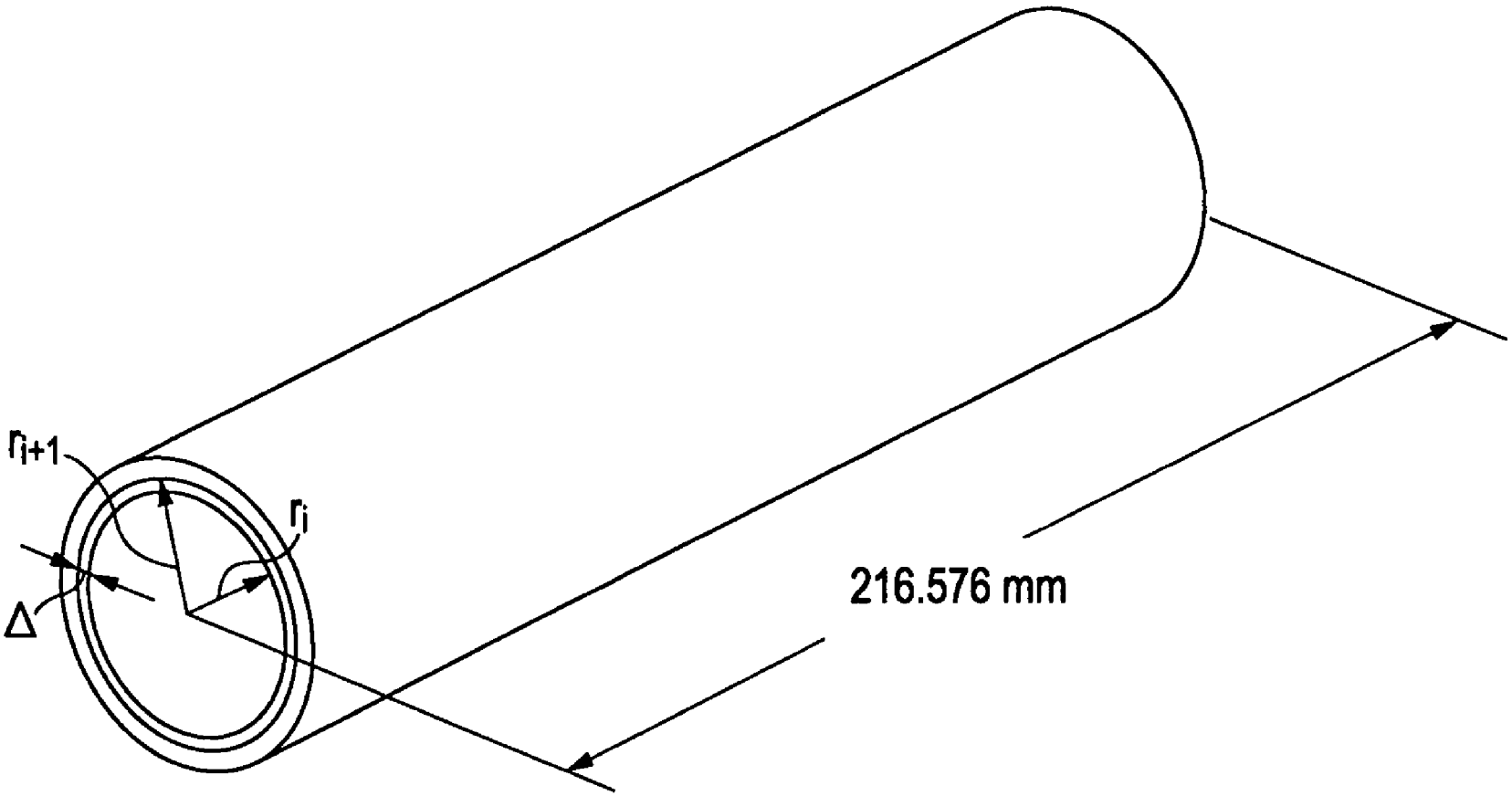
FIG. 11 is an explanatory illustration for obtaining the absorption weight.

As shown in FIG. 11, first, using a volume of a layer having a thickness Δ from a radius $r_i$ to a radius $r_{i+1}$, the porosity of the absorbent 37 being 80%, and a volume of one pore 37*a* ($1.767\times10^{-9}$ $cm^3$); the number of the pores 37*a* included in the layer having the thickness Δ is calculated. Then, using the number of the pores 37*a* in the layer with the thickness Δ, and the surface area of the one pore 37*a* ($7.069\times10^{-6}$ $cm^2$); the subtotal of the surface areas of the pores 37*a* in the layer with the thickness Δ may be obtained. By integrating the subtotal surface areas from the surface of the cleaning roller 34 to the impregnation depth impregnated with the solution; the total surface area of the pores 37*a* included in the layers from the surface of the cleaning roller 34 to the given depth may be obtained.

According to the above-described calculation method, the total surface area (S) of the pores 37*a* included in the layers from the surface of the cleaning roller 34 to 0.1059 mm depth is 2018 $cm^2$. Note that, since the pores of the cleaning roller 34 is the open-cell type, the total surface area (S) of the pores 37*a* may be considered as about 2000 $cm^2$.

Since the projected area (s) when the molecules of the surfactant are projected into the absorption plane is $9.6\times10^{-17}$ ($cm^2$), the molecularity (Mn) of the surfactant necessary for covering the total surface area of the pores 37*a* may be the following value:

$$Mn=S/s=2000/9.6\times10^{-17}\approx2.08\times10^{19}$$

Since the molecular weight (M) of the surfactant is 664, and the Avogadro's number (Na) is $6.0\times10^{23}$, the necessary maximum amount (W) of the surfactant may be the following value:

$$W=Mn/Na\times M=2.08\times10^{19}/6.0\times10^{23}\times664=0.0230(g)$$

Since the weight of the solution (W0) is 0.5040 g as shown in Table 1, the maximum content of the surfactant may be the following value:

$$\text{(Maximum Content)}=W/W0\times100=0.0230/0.5040\times100=4.56(\text{wt }\%)$$

Therefore, the maximum content of the surfactant is 4.56 wt %. According to the solution impregnated into the cleaning roller 34, the maximum content of the surfactant is 4.56 wt %, however, even if the content of the surfactant is less than 4.56 wt %, the absorbing capability for the ink i can be provided sufficiently.

Therefore, the part 40 impregnated with the solution of the cleaning roller 34 holds the surfactant by the maximum content of 4.56 wt %, and has the depth in the range of from 3.7 to 226.2 μm from the surface of the cleaning roller 34.

The cleaning roller 34 according to the above-described configuration, as shown in FIGS. 8 and 9, immediately before the ink i is ejected, namely, when the head cap 24 moves from the bottom surface of the head cartridge 2 to expose the ejection surface 23*a*, the cleaning roller 34 comes into contact with and rotates on the ejection surface 23*a* at proper pressure, so as to provide the plural actions, such as the larger capillarity (Qn) of the squeezed pores 37*a* than that of the not-squeezed pores 37*a*, and the sucking capability (Qr) generated when the pressure is released and the pores 37*a* are restored to the original size. Hence, the cleaning roller 34 may absorb the thickened and solidified ink i adhering to the ejection surface 23*a*, the thickened and solidified ink i in the nozzles 27*a*, the dusts, and the like.

Further, the solution containing the surfactant which is impregnated into the surface layer 39 by the depth in the range of from the 3.7 to 226.2 μm from the surface of the cleaning roller 34 enhances the wettability of the surface layer 39, which comes into contact with the ink i, so that the ink i has an affinity to the solution, and thus the ink i is easily absorbed into the cleaning roller 34. As a result, in the cleaning roller 34, the capillarity (Qn) for absorbing the ink i increases, and the absorbing capability for the ink i adhering to the ejection surface 23*a*, the thickened and solidified ink i, the dusts, and the like, increases. Therefore, the cleaning roller 34 may reliably remove the excess ink i adhering to the ejection surface 23*a*, the thickened and solidified ink i, the dusts, and the like, which may block the ejection of the ink i, thereby increasing the cleaning effect. Since the cleaning roller 34 may reliably remove the excess ink i and the dusts, the ejection can be satisfactory recovered, and thus the ejection ability can increase.

Since the cleaning roller 34 has the depth of the part 40 impregnated with the solution in the range of from 3.7 to 226.2 μm, the ink i would not be absorbed excessively, but the ink i adhering to the ejection surface 23*a* and the thickened and solidified ink i in the nozzles 27*a* can be properly removed. Therefore, the cleaning roller 34 may be used for a long time, and the life thereof can be extended. In addition, since the ink i is not absorbed excessively, the amount of waste of the ink i may be suppressed, thereby preventing increase in cost.

In addition, since the cleaning roller 34 is impregnated with the solution containing the surfactant, the cleaning roller 34 has the ink-absorbing capability for absorbing the ink i even numbering the early operation state of cleaning, thereby providing stable absorption of the ink i even when the number of cleaning increases. The cleaning roller 34 can provide the stable cleaning effect, keep the ejection ability high, and keep the image quality stable.

Further, since the cleaning roller 34 can absorb the mist around the nozzles 27*a*, the color mixture due to the mist can be prevented. As described above, the cleaning roller 34 can effectively remove the ink i and the dusts adhering to the ejection surface 23*a*, and the thickened and solidified ink i in the nozzle 27*a*, as compared to the cleaning roller, in which the surface layer 39 is not impregnated with the solution, or the known blade. Therefore, the ink i can be ejected even when the printing has not been performed for a long time, and thus, the ink i has not been ejected for a long time, thereby constantly providing the stable ejection performance.

While the cleaning roller 34 is rotatably supported at the supporting part 38 of the head cap 24, the cleaning roller 34 may be fixed at the supporting part 38 without rotating. Since the cleaning roller 34 is fixed at the supporting part 38 without rotating, resistance occurs when the cleaning roller 34 moves on the ejection surface 23*a*. Therefore, the cleaning roller 34 can provide not only the capillarity, but also scraping off the thickened and solidified ink i and the like adhering to the ejection surface 23*a*. Alternatively, the cleaning roller 34 may be provided with a brake mechanism for controlling the rotation thereof inside the head cap 24, so that the rotation speed of the cleaning roller 34 may be reduced for causing the resistance to occur when moving on the ejection surface 23*a*.

The cleaning roller 34 may be detached from the supporting part 38 of the head cap 24, and may be replaced.

Next, the device body 3, on which the above-described head cartridge 2 will be described.

Figure 12:
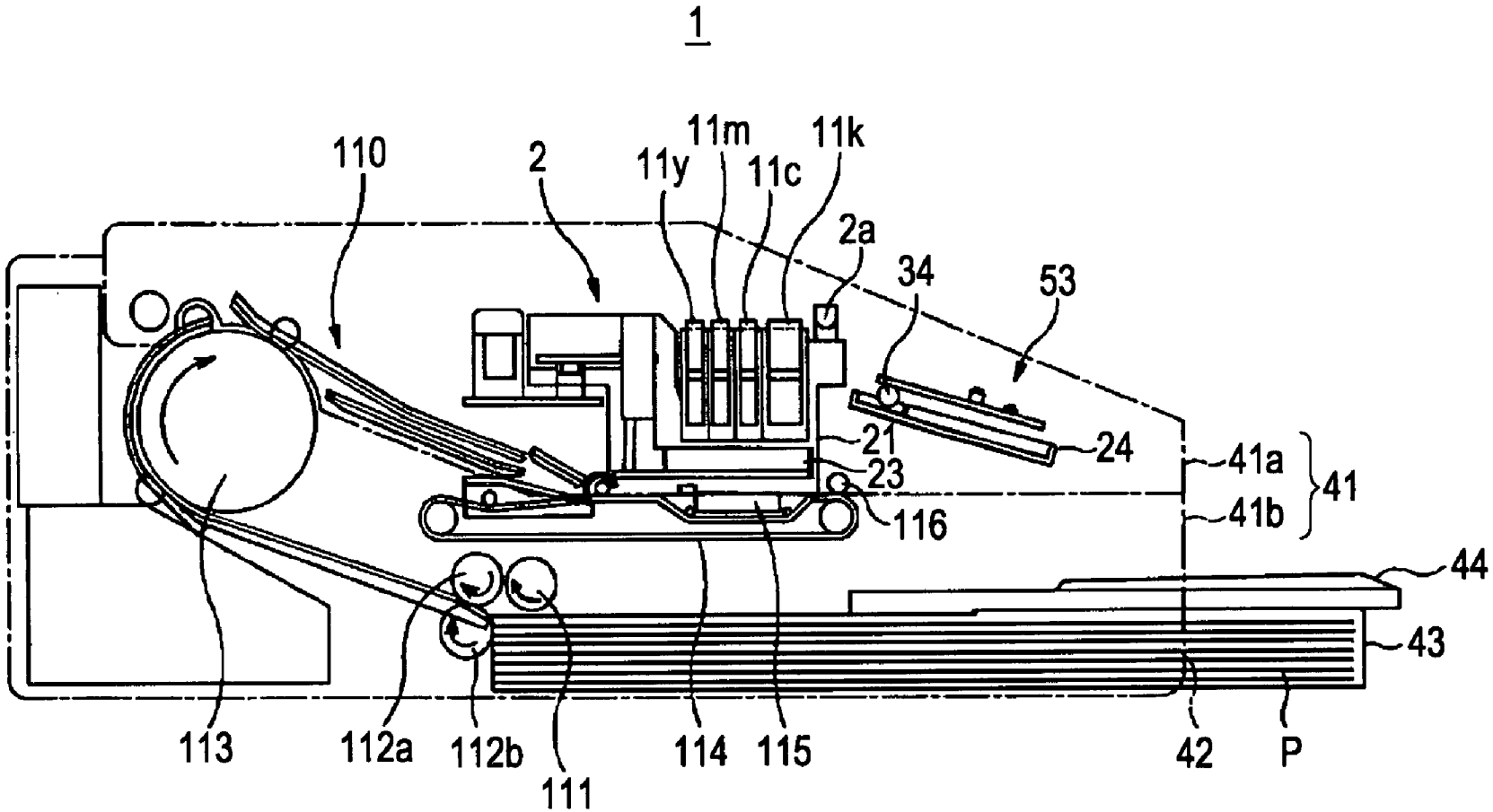
FIG. 12 is a perspective lateral view showing a part of the printer in a printable state.

As shown in FIG. 12, the device body 3 is assembled in a casing 41 including an upper casing 41*a* and a lower casing 41*b*, for preventing the dusts and the like from entering inside the device body 3. The upper casing 41*a* is detachably attached to the lower casing 41*b*.

In the front surface of the casing 41, a paper-feeding-and-discharging port 42 is provided for feeding and discharging the recording sheet P. A storage tray 43 is attached at the lower side of the paper-feeding-and-discharging port 42, for storing unprinted recording sheet P. A discharge tray 44 is provided above the storage tray 43, so that printed recording sheet P is discharged to the discharge tray 44.

As shown in FIG. 1, a head-mounting part 51 is provided in the upper casing 41*a*, and the above-described head cartridge 2 is mounted on the head-mounting part 51. When the head cartridge 2 is mounted on the head-mounting part 51, the ejection surface 23*a* of the head cartridge 2 is exposed to a printing position (described below) in the lower casing 41*b*. In order to keep the mounting state of the head cartridge 2, locking holes 52 are provided at the head-mounting part 51, for locking knobs 2*a* provided at the head cartridge 2. Hence, in the head-mounting part 51, the ejection surface 23*a* of the head cartridge 2 becomes parallel to the recording sheet P transported to the printing position, and the parallel state is kept.

As shown in FIG. 12, a head-cap-moving mechanism 53 is provided at the casing 41. The head-cap-moving mechanism 53 opens and closes the ejection surface 23*a* by moving the head cap 24 between a closed position where the ejection surface 23*a* is closed since the head cap 24 of the head cartridge 2 mounted on the head-mounting part 51 faces the ejection surface 23*a*; and an open position where the ejection surface 23*a* is open since the head cap 24 moves to the upper front side of the upper casing 41*a*.

Figure 13:
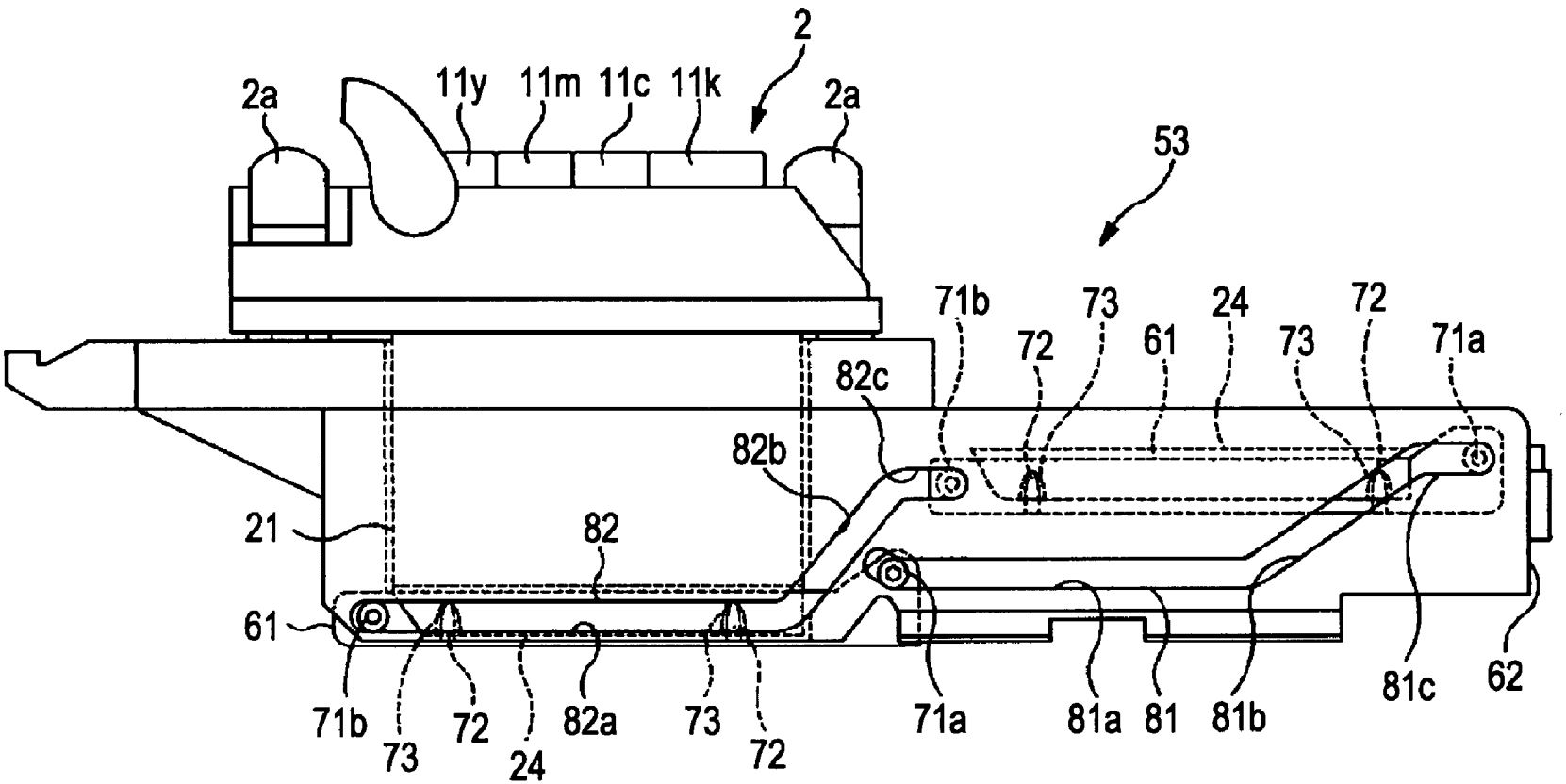
FIG. 13 is a lateral view schematically showing a configuration of a guide part as a head-cap-moving mechanism.
Figure 14:
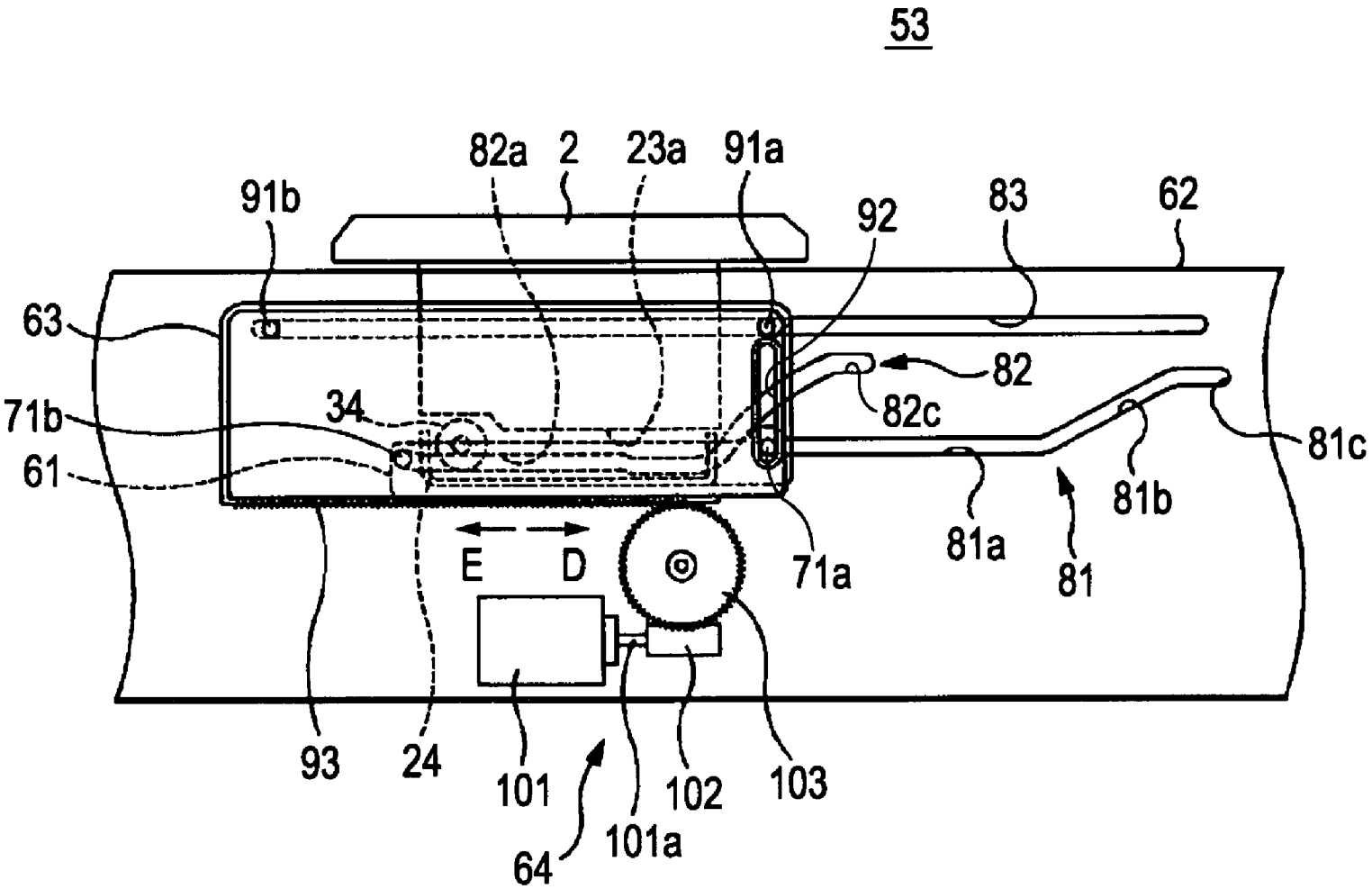
FIG. 14 is a perspective lateral view showing a part of a configuration of a driving mechanism of the head-cap-moving mechanism.

As shown in FIGS. 13 and 14, the head-cap-moving mechanism 53 includes a movable slider 61 for holding the head cap 24, guide plates 62 for guiding the movement of the slider 61, moving plates 63 for moving the slider 61, and a driver 64 for moving the moving plates 63.

The slider 61 is provided in the upper casing 41*a* in which the head-mounting part 51 is provided. The slider 61 has a substantially rectangular frame corresponding to the head cap 24 so as to hold the outer periphery of the head cap 24. In the slider 61, a pair of front guide pins 71*a* and a pair of back guide pins 71*b* project outward from the both ends in a longitudinal direction of both sides of the slider 61. In these guide pins 71*a* and 71*b*, the length of the guide pins 71*a* provided at the front side of the casing 41 are longer than that of the guide pins 71*b* at the back side, so as to be inserted to guide holes 81 (described later) of the guide plates 62.

In the slider 61, engaging protrusions 72 are formed at the both ends in the longitudinal direction of the both sides of the slider 61 toward the inside of the frame. Correspondingly, in the head cap 24, engaging recesses 73 are formed at the front and back ends of the both sides of the bottom surface of the head cap 24, the engaging protrusions 72 being engaged with the engaging recesses 73. The engaging protrusions 72 of the slider 61 are engaged with the engaging recesses 73 of the head cap 24 when the head cartridge 2 is mounted on the head-mounting part 51, so that the slider 61 holds the head cap 24.

The guide plates 62 are provided at the both ends of the slider 61, where the guide pins 71*a* and 71*b* are provided, and are integrally formed with the lateral surfaces of the head-mounting part 51. The guide plate 62 have the guide holes 81, to which the guide pins 71*a* provided at the front side of the slider 61 are inserted, and guide holes 82, to which the guide pins 71*b* provided at the back side of the slider 61 are not inserted therethrough, but engaged.

The pair of front guide holes 81 and the pair of back guide holes 82 include first horizontal parts 81*a* and 82*a*, for allowing the slider 61 to move in parallel to the ejection surface 23*a*; inclined parts 81*b* and 82*b*, for guiding the slider 61 in a vertical direction; and second horizontal parts 81*c* and 82*c*, for supporting the slider 61 horizontally at the open position, respectively, in a continuous manner.

The first horizontal parts 81*a* and 82*a*, when the ejection surface 23*a* is opened or closed, guide the guide pins 71*a* and 71*b* of the slider 61 to move in parallel to the ejection surface 23*a*, so that the head cap 24 moves in parallel to the ejection surface 23*a*.

The inclined parts 81*b* and 82*b*, when the ejection surface 23*a* is opened, guide the guide pins 71*a* and 71*b* of the slider 61 to the upper front side of the upper casing 41*a*, so that the slider 61, which have been guided by the first horizontal parts 81*a* and 82*a*, moves to the upper front side of the upper casing 41*a* from the position facing the ejection surface 23*a*. On the other hand, the inclined parts 81*b* and 82*b*, when the ejection surface 23*a* is closed, guide the slider 61, which have been guided by the second horizontal parts 81*c* and 82*c*, from the upper front side of the upper casing 41*a* to the lower back side of the upper casing 41*a* to a position facing the ejection surface 23*a*.

The second horizontal parts 81*c* and 82*c* guide the guide pins 71*a* and 71*b* of the slider 61, which has been guided by the inclined parts 81*b* and 82*b* to the upper front side of the upper casing 41*a*, to the upper front side of the upper casing 41*a* and to be horizontal.

As described above, the guide plates 62 guide the guide pins 71*a* and 71*b* of the slider 61 from the first horizontal parts 81*a* and 82*a* to the second horizontal parts 81*c* and 82*c* via the inclined parts 81*b* and 82*b*. Therefore, the head cap 24 supported by the slider 61 is movable between the closed position and the open position of the ejection surface 23*a*.

As shown in FIG. 14, the moving plates 63 for moving the slider 61 are made of substantially rectangular flat plates, and are disposed outside and along the guide plates 62, respectively. A pair of front guide pins 91*a* and a pair of back guide pins 91*b* protrude to the guide plates 62 at the upper portion of the moving plates 63. Correspondingly, horizontal slits 83 are formed in the guide plates 62 to linearly extend in the front-back direction, and the guide pins 91*a* and 91*b* are engaged with the horizontal slits 83. Since the guide pins 91*a* and 91*b* slide inside the horizontal slits 83 of the guide plates 62, the moving plates 63 can slide in the front-back direction in parallel to the guide plates 62.

In addition, vertical slits 92 are provided in the moving plates 63 at the front side of the casing 41 to extend linearly in the vertical direction. The front guide pins 71*a* of the slider 61 inserted to the guide holes 81 provided at the front side of the guide plates 62 are engaged with the vertical slits 92.

A rack gear 93 is formed at the lower end of each moving plate 63 to extend in the front-back direction of the moving plate 63, and is engaged with a pinion gear 103 (described later) of the driver 64. Therefore, the moving plate 63 receives power from the driver 64, and is movable.

As shown in FIG. 14, the driver 64 is provided in the lower casing 41*b*. The driver 64 includes a driving motor 101, a worm gear 102 connected to a rotation shaft 101*a* of the driving motor 101, and the pinion gear 103 meshed with the worm gear 102.

In the above-described head-cap-moving mechanism 53, while the head cap 24 closes the ejection surface 23*a*, the guide pins 71*a* and 71*b* of the slider 61 are supported by the first horizontal parts 81*a* and 82*a* of the guide holes 81 and 82 provided in the guide plates 62, as shown in FIG. 14. The front guide pins 71*a* of the slider 61 inserted to the guide holes 81 provided at the front side of the guide plates 62 are located at the lower side of the vertical slits 92 provided in the moving plates 63, as shown in FIG. 14.

In order to open the ejection surface 23*a*, when the driving motor 101 of the driver 64 rotates, the worm gear 102 connected to the rotation shaft 101*a* of the driving motor 101 starts rotating, and the pinion gear 103 meshed with the worm gear 102 starts rotating. Then, the guide pins 91*a* and 91*b* provided at the moving plates 63 move in an arrow D direction shown in FIG. 14 along the horizontal slits 83 of the guide plates 62, and the moving plates 63 move to the upper front side of the upper casing 41*a*. When the moving plates 63 move to the front side of the casing 41, since the guide pins 71*a* of the slider 61 are engaged with the vertical slits 92 of the moving plates 63, the slider 61 is pulled by the moving plates 63. While the guide pins 71*a* of the slider 61 are located at the lower side of the vertical slits 92, the guide pins 71*a* move along the first horizontal parts 81*a* of the guide holes 81 of the guide plates 62, and the guide pins 71*b* move along the first horizontal parts 82*a* of the guide holes 82. Therefore, the head cap 24 moves to the front side of the upper casing 41*a* in parallel to the ejection surface 23*a*.

In addition, since the pinion gear 103 of the driver 64 rotates and the moving plates 63 move to the front side of the casing 41, the guide pins 71*a* of the slider 61 are pulled by the moving plate 63. Therefore, the guide pins 71*a* move along the inclined parts 81*b* of the guide holes 81 of the guide plates 62, the guide pins 71*b* move along the inclined parts 82*b* of the guide holes 82, and the guide pins 71*b* move to the upper side of the vertical slits 92 of the moving plates 63. Therefore, the head cap 24 moves to the front side of the upper casing 41*a* while opening the ejection surface 23*a*.

Further, since the pinion gear 103 of the driver 64 rotates and the moving plates 63 move to the front side of the upper casing 41*a* in the arrow D direction shown in FIG. 14, the guide pins 71*a* of the slider 61 are pulled by the moving plates 63. While the guide pins 71*a* are located at the upper side of the vertical slits 92, the guide pins 71*a* move along the second horizontal parts 81*c* of the guide holes 81 of the guide plates 62, and the guide pins 71*b* move along the second horizontal parts 82*c* of the guide holes 82 of the guide plates 62. Therefore, the head cap 24 is held at the front side of the upper casing 41*a*, and the ejection surface 23*a* is in the open state.

On the other hand, in order to close the ejection surface 23*a* with the head cap 24, the driving motor 101 of the driver 64 rotates in a direction opposite to that in the case of opening the ejection surface 23*a*, and the moving plates 63 move from the front side to the back side of the upper casing 41*a* in an arrow E direction shown in FIG. 14. When the moving plates 63 move to the back side of the upper casing 41*a*, the guide pins 71*a* of the slider 61 are pulled by the moving plate 63. While the guide pins 71*a* are located at the upper side of the vertical slits 92, the guide pins 71*a* move along the second horizontal parts 81*c* of the guide holes 81 of the guide plates 62, and the guide pins 71*b* move along the second horizontal parts 82*c* of the guide holes 82.

In addition, since the pinion gear 103 of the driver 64 rotates and the moving plates 63 move to the back side of the upper casing 41*a* in the arrow E direction shown in FIG. 14, the guide pins 71*a* of the slider 61 are pulled by the moving plates 63. Therefore, the guide pins 71*a* move along the inclined parts 81*b* of the guide holes 81 of the guide plates 62, the guide pins 71*b* move along the inclined parts 82*b* of the guide holes 82, and the guide pins 71*b* move to the lower side of the vertical slits 92 of the moving plates 63. Therefore, the head cap 24 moves to the position facing the ejection surface 23*a*.

Further, since the pinion gear 103 of the driver 64 rotates and the moving plates 63 move to the back side of the upper casing 41*a* in the arrow E direction shown in FIG. 14, the guide pins 71*a* of the slider 61 are pulled by the moving plates 63. While the guide pins 71*a* are located at the lower side of the vertical slits 92, the guide pins 71*a* move along the first horizontal parts 81*a* of the guide holes 81 of the guide plates 62, and the guide pins 71*b* move along the first horizontal parts 82*a* of the guide holes 82. Therefore, the head cap 24 moves to the back side of the casing 41 in parallel to the ejection surface 23*a*, and closes the ejection surface 23*a*.

As described above, the head-cap-moving mechanism 53 opens and closes the ejection surface 23*a* since the head cap 24 moves between a closed position where the ejection surface 23*a* is closed since the head cap 24 faces the ejection surface 23*a*; and an open position where the ejection surface 23*a* is open since the head cap 24 moves to the upper front side of the upper casing 41*a*.

In the printer 1 with the above-described configuration, a controller controls current to be applied to the head-cap-moving mechanism 53, the paper-feeding-and-discharging mechanism 110 provided in the lower casing 41*b*, and the ink ejection head 23, based on the print data input from an external information processing device.

In particular, in the printer 1, when an operation button 41*c* provided at the casing 41 is operated to give a print-start instruction to the controller, the controller sends control signals to drive the head-cap-moving mechanism 53 and the paper-feeding-and-discharging mechanism 110, thereby being a printable state, as shown in FIG. 12.

In the printer 1, the head-cap-moving mechanism 53 allows the head cap 24 to move with respect to the head cartridge 2, to the upper front side of the upper casing 41*a* with the storage tray 43 and the discharge tray 44 provided. Due to this, in the printer 1, the nozzles 27*a* provided in the ejection surface 23*a* of the ink ejection head 23 are exposed to the outside so as to eject the ink i.

In the printer 1, since the head cap 24 moves, the cleaning roller 34 provided at the head cap 24 rotates on the ejection surface 23*a* to clean the ejection surface 23*a* by absorbing the excess ink i adhering to the ejection surface 23*a* and the thickened and solidified ink i in the nozzles 27*a*. In the printer 1, since the surface layer 39 of the cleaning roller 34 is impregnated with the solution containing the surfactant, the wettability of the surface layer 39 of the cleaning roller 34, which comes into contact with the ink i, may increase, and the ink i may have an affinity to the solution. In the printer 1, the affinity of the ink i facilitates the absorption of the ink i by the cleaning roller 34, and the cleaning roller 34 can reliably and effectively absorb the ink i adhering to the ejection surface 23*a*, the thickened and solidified ink i, the dusts, and the like. Therefore, in the printer 1, since the thickened and solidified ink i can be reliably removed from the ejection surface 23*a* and from the nozzles 27*a*, non-ejection of the ink i, which may cause unprinted spots, may be prevented. In addition, in the printer 1, since the ejection surface 23*a* is cleaned prior to the printing, the ejected ink i would not be mixed with other-color ink i, and the color mixture may be prevented.

In the printer 1, with the paper-feeding-and-discharging mechanism 110, a feeding roller 111 draws the recording sheet P from the storage tray 43, a pair of separating rollers 112*a* and 112*b*, which rotate in directions opposite to each other, selectively draws only one recording sheet P and transports it to a reverse roller 113, the reverse roller 113 reverses the transporting direction of the recording sheet P and transports it to a conveyor belt 114 provided at a position facing the ejection surface 23*a* of the ink ejection head 23. In the printer 1, a platen 115 supports the recording sheet P, transported by the conveyor belt 114, at a predetermined position, so that the recording sheet P faces the ejection surface 23*a*.

Then, in the printer 1, heat is generated at the heating resistor 26*a*, which is provided at the ink ejection head 23, based on the control signals of the print data. In the printer 1, as shown in FIG. 4, the heat at the heating resistor 26*a* allows the nozzle 27*a* to eject the droplet of ink i on the recording sheet P transported to the printing position, and thus, images, characters, etc., composed of ink dots are printed.

In the printer 1, when the droplet of ink i is ejected from the nozzle 27*a*, an amount of the ink i equivalent to the ejected ink i is supplied to the ink ejection head 23 from the ink tank section 11 via the connection part 25.

Then, in the printer 1, the conveyor belt 114 which rotates to transport the printed recording sheet P to the paper-feeding-and-discharging port 42, and a discharge roller 116 provided at the paper-feeding-and-discharging port 42 side to face the conveyor belt 114 transports the recording sheet P to the discharge tray 44.

The printer 1 performs printing on the recording sheet P in the above-described manner. With this printer 1, since the cleaning roller 34, in which the surface layer 39 is impregnated with the solution containing the surfactant, cleans the ejection surface 23*a* when the head cap 24 is opened, the ink i adhering to the ejection surface 23*a* and the thickened and solidified ink i in the nozzles 27*a* can be properly removed. With the printer 1, by the proper removal of the ink i, highly qualified images without color mixture, unprinted spots, and the like, may be provided.

The above-described printer 1 employs the electrothermal transducer system in which the heating resistor 26*a* heats the ink i and the nozzle 27*a* ejects the ink i. However, the system is not limited thereto. For example, the printer 1 may employ an electromechanical transducer system in which ink i is electromechanically ejected from a nozzle with an electromechanical transducer element, such as a piezoelectric element.

Further, the line-type printer 1 has been described above. However, the present invention is not limited thereto. For example, the present invention is also applicable to a serial-type printer in which a head cartridge 2 moves in a direction substantially orthogonal to the traveling direction of a recording sheet P.

The embodiment in which the present invention is applied to a printer has been described above. However, the present invention is not limited to the disclosed embodiment. The present invention can also be widely applied to other liquid ejection devices for ejecting liquid. For example, the present invention can be applied to facsimile machines, copy machines, liquid ejection devices for DNA chips suspended in liquid (Japanese Unexamined Patent Application Publication No. 2002-253200), and liquid ejection devices for ejecting liquid containing conductive particles for forming interconnecting patterns in printed wiring boards.

EXAMPLES

Example 1, and Comparisons 1 and 2 will be described below. Example 1, and Comparisons 1 and 2 vary in treatment methods for the surfaces of the cleaning rollers of the printers, each of which the present invention is applied.

Example 1

In Example 1, the following cleaning roller was manufactured. The material of the prepared cleaning roller is polyethylene, and is an elastically deformable porous body. The porosity is 80%. The shape of the cleaning roller is a crown, the mean diameter thereof is 9.0 mm, and the effective length is 225 mm. The nip width of the cleaning roller is 1.2 mm. The surface layer of the cleaning roller was impregnated with the solution, which was prepared as the surfactant by adding 2,4,7,9-tetramethyl-5-decin-4,7,-diol-di(polyoxyethylene) ether with the content of 0.35 wt %; glycerin with the content of 9.0 wt % as the nonvolatile solution; 2-pyrrolidone with the content of 6.3 wt %; and water with the content of 84.35 wt %. The surface layer was impregnated with the solution so that the impregnation weight became in the range of from 0.312 to 1.050 g. The cleaning roller was left for 60 minutes, and then, left in an oven set at 30° C. for 14 hours to be dried. The impregnation weight of the solution in the cleaning roller was 0.6510 g, and thus the cleaning roller corresponds to the sample 10 shown in Table 1. Therefore, the cleaning roller in which the surface layer thereof was impregnated with the solution by the depth of 0.1373 mm (137.3 μm) from its surface was manufactured.

Comparison 1

In Comparison 1, the cleaning roller was manufactured in a similar manner to that of Example 1, except that the cleaning roller equivalent to that of Example 1 was entirely impregnated with the solution. This cleaning roller corresponds to the sample 48 shown in Table 1.

Comparison 2

In Comparison 2, the same cleaning roller was used as that of Example 1. However, the cleaning roller was not treated with the solution. This cleaning roller corresponds to the sample 1 shown in Table 1.

Figure 15:
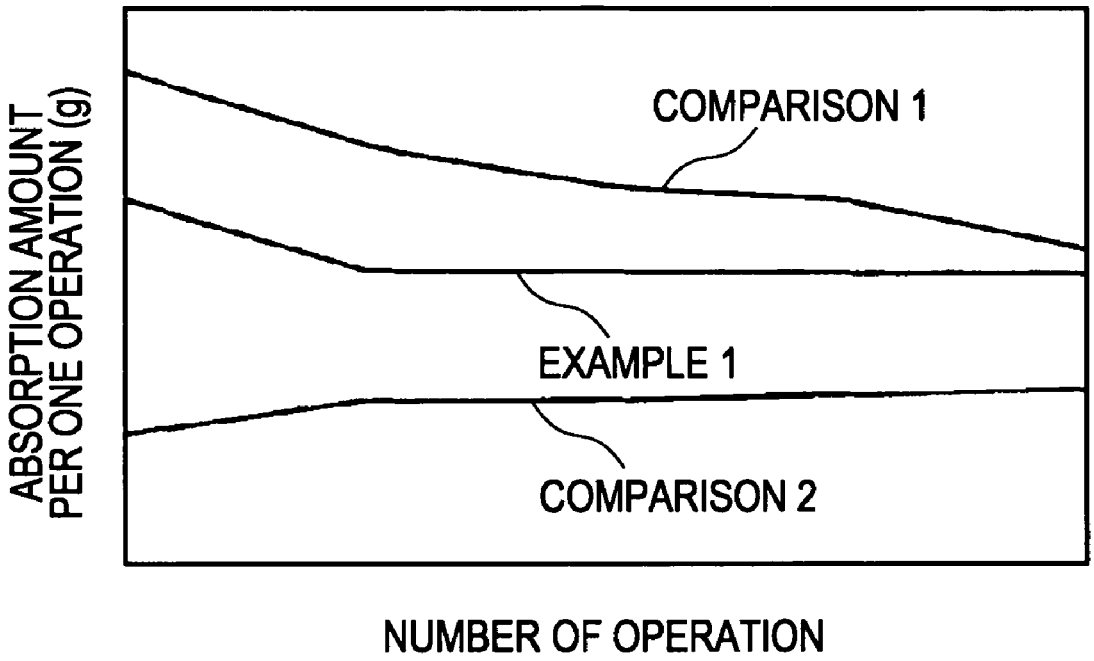
FIG. 15 is a comparative graph showing absorption characteristics according to Example 1, and Comparisons 1 and 2.

Ink-absorbing characteristics of the cleaning rollers according to Example 1, and Comparisons 1 and 2 were compared. In addition, the images were evaluated for lines and color mixture according to each cleaning roller, immediately after each cleaning roller was replaced with new one, i.e., after a first sheet was printed. The check method and evaluation method include printing an image in a wide area of the recording sheet P by using the ink ejection head with the four-color nozzle lines of yellow, magenta, cyan, and black;

and cleaning the ejection surface with the cleaning roller 34 each time when printing is performed on one sheet. The comparison results of the ink-absorbing characteristics according to the cleaning rollers are shown in FIG. 15, and the evaluation results are shown in Table 5.

TABLE 5

| | Line in Image | Color Mixture |
|---|---|---|
| Example 1 | ○ | ○ |
| Comparison 1 | ○ | x |
| Comparison 2 | x | x |

As shown in the comparison results of the ink-absorbing characteristics, in Example 1, a certain amount of the ink was absorbed even in the early operation state, i.e., when the number of the cleaning operation was small, and the absorption amount of the ink was stable even when the number of the cleaning operation increases. Accordingly, the life of the cleaning roller was long in Example 1.

In Comparison 1, the absorption amount of the ink was large even when the number of the cleaning operation was small, and the total absorption amount also increased. In addition, in Comparison 1, more the number of operation increased, more the absorption amount per one cleaning operation decreased, and thus the absorption amount tended to decrease. Accordingly, the life of the cleaning roller was short according to Comparison 1.

In Comparison 2, since the cleaning roller was not impregnated with the solution, and was untreated, the ink-absorbing capability was small and the absorption amount of the ink was small even though the number of operation increased, and the total absorption amount was small. Therefore, in Comparison 2, the ink adhering to the ejection surface or the thickened and solidified ink in the nozzles were not sufficiently absorbed.

Concerning the evaluations on the images for the lines and the color mixture according to Example 1, and Comparisons 1 and 2, on the basis of the results shown in Table 5, the evaluations on the lines and the color mixture of the images according to Example 1 was preferable as compared to that according to Comparisons 1 and 2.

In Example 1, since the surface layer of the cleaning roller was impregnated with the solution containing the surfactant, the ink had an affinity to the solution when the ejection surface was cleaned, and therefore, the cleaning roller could properly absorb the excess ink adhering to the ejection surface and the thickened and solidified ink in the nozzles. Owing to this, according to Example 1, the cleaning roller could properly absorb the ink with the ink-absorbing characteristic even in the early operation state, and provided the stable ink-absorbing characteristic as compared to Comparisons 1 and 2. In addition, according to Example 1, since the cleaning roller could properly absorb the ink even in the early operation state, the cleaning roller could absorb the thickened and solidified ink, and non-ejection of the ink could be prevented even in the early operation state, thereby the lines did not appear in the images. According to Example 1, since the excess ink adhering to the ejection surface was absorbed, the color mixture was prevented.

In contrast, according to Comparison 1, since the cleaning roller was entirely impregnated with the solution, as shown in FIG. 15, the absorption amount of the ink per one cleaning operation increased, and thus, the total absorption amount increased. In addition, according to Comparison 1, more the number of cleaning operation increased, more the absorption amount of the ink into the cleaning roller increased. Therefore the ink-absorbing capability of the cleaning roller decreased, and the cleaning roller was no longer able to absorb the excess ink adhering to the ejection surface or the thickened and solidified ink in the nozzles. Therefore, according to Comparison 1, the ink adhering to the ejection surface was mixed with the ejected ink, thereby the color mixture appeared.

According to Comparison 2, since the cleaning roller was not impregnated with the solution and thus untreated, the cleaning roller absorbed the ink only by the capillarity of the pores of the porous body. Therefore, the cleaning roller could not sufficiently absorb the ink adhering to the ejection surface or the thickened and solidified ink in the nozzles, and as shown in FIG. 15, the absorption amount was small as compared to that of Example 1, in which the cleaning roller was impregnated with the solution. Therefore, according to Comparison 2, the lines and the color mixture appeared in the images in the early operation state.

Accordingly, it is very important that the surface layer of the cleaning roller is impregnated with the solution containing the surfactant since the ink has an affinity to the solution when the ejection surface is cleaned, and thus the absorbing capability increases.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid ejection device comprising:

a liquid ejection head having an ejection surface and a plurality of ejection ports formed at the ejection surface, the liquid ejection head operable to eject a droplet of liquid from the ejection ports;

an elastic absorbing member which comes into contact with the ejection surface of the liquid ejection head that absorbs the liquid adhering to the ejection surface; and moving means for moving the absorbing member with respect to the ejection surface while the absorbing member is in contact with the ejection surface, wherein the absorbing member has a surface layer which is impregnated with a solution containing a surfactant, wherein the absorbing member is a porous body having a porosity of 80±3%, and an impregnation depth of the solution containing the surfactant from a surface of the absorbing member is in a range of from 3.7 to 226.2 μm.

2. A liquid ejection device comprising:

a liquid ejection head which includes an ejection surface and a plurality of ejection ports formed at the ejection surface, the liquid ejection head operable to eject a droplet of liquid from the ejection ports;

an elastic absorbing member which comes into contact with the ejection surface of the liquid ejection head, and absorbs the liquid adhering to the ejection surface; and a moving unit which moves the absorbing member with respect to the ejection surface while the absorbing member is in contact with the ejection surface, wherein the absorbing member has a surface layer which is impregnated with a solution containing a surfactant and an impregnation depth of the solution containing the surfactant from a surface of the absorbing member is in a range of from 3.7 to 226.2 μm.

* * * * *